US011508326B2

(12) United States Patent
Kang et al.

(10) Patent No.: US 11,508,326 B2
(45) Date of Patent: Nov. 22, 2022

(54) DISPLAY APPARATUS AND OPERATING METHOD THEREOF

(71) Applicant: SAMSUNG ELECTRONICS CO., LTD., Suwon-si (KR)

(72) Inventors: Jinmo Kang, Suwon-si (KR); Seungjin Baek, Suwon-si (KR); Hosik Sohn, Suwon-si (KR); Hoyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/069,480

(22) Filed: Oct. 13, 2020

(65) Prior Publication Data

US 2021/0125570 A1 Apr. 29, 2021

(30) Foreign Application Priority Data

Oct. 25, 2019 (KR) ..... 10-2019-0134115

(51) Int. Cl.

*G09G 3/00* (2006.01)
*G09G 3/36* (2006.01)
*G09G 3/3216* (2016.01)

(52) U.S. Cl.

CPC ..... *G09G 3/364* (2013.01); *G09G 3/3216* (2013.01); *G09G 2320/0233* (2013.01);

(Continued)

(58) Field of Classification Search

CPC ..... G09G 2320/0626; G09G 3/3216; G09G 3/364; G09G 2360/145; G09G 2320/0233;

(Continued)

(56) References Cited

U.S. PATENT DOCUMENTS 10,111,296 B2 10/2018 Wu et al.
2007/0146266 A1* 6/2007 Yasuda ..... G09G 3/006 345/88

(Continued)

FOREIGN PATENT DOCUMENTS

JP 2007-140325 A 6/2007
KR 10-2016-0011300 A 2/2016
KR 10-2018-0058048 A 5/2018

OTHER PUBLICATIONS

International Search Report (PCT/ISA/210) and Written Opinion (PCT/ISA/237) dated Jan. 15, 2021 issued by the International Searching Authority in International Application No. PCT/KR2020/013579.

*Primary Examiner* — Michael A Faragalla
(74) *Attorney, Agent, or Firm* — Sughrue Mion, PLLC

(57) ABSTRACT

A display apparatus includes a display panel including a plurality of pixels, each pixel of the plurality of pixels having a plurality of light-emitting devices; a storage configured to store a plurality of calibration matrices for each pixel of the plurality of pixels; a processor configured to identify a calibration matrix according to input data of the plurality of pixels and to calibrate modulation data corresponding to the input data based on the identified calibration matrix; and a panel driver configured to drive the display panel by applying a driving signal generated from the calibrated modulation data to the light-emitting devices of the plurality of pixels, wherein the plurality of calibration matrices includes a white calibration matrix and a color calibration matrix.

9 Claims, 10 Drawing Sheets

(52) U.S. Cl.
CPC ..... *G09G 2320/0271* (2013.01); *G09G 2320/0626* (2013.01); *G09G 2320/0693* (2013.01)

(58) Field of Classification Search
CPC ..... G09G 3/32; G09G 2320/0271; G09G 2320/0693; G09G 3/2003; G09G 2320/0242
See application file for complete search history.

(56) References Cited

U.S. PATENT DOCUMENTS

| | | | | |
|---|---|---|---|---|
| 2007/0177230 | A1* | 8/2007 | Kreysar ..... | H04N 1/6033 358/1.9 |
| 2016/0019865 | A1 | 1/2016 | Han et al. | |
| 2017/0330498 | A1* | 11/2017 | Orio ..... | G09G 3/3607 |
| 2018/0144716 | A1 | 5/2018 | Jung et al. | |
| 2019/0213941 | A1 | 7/2019 | Beon et al. | |

* cited by examiner

DISPLAY APPARATUS AND OPERATING METHOD THEREOF

CROSS-REFERENCE TO RELATED APPLICATION

This application is based on and claims priority under 35 U.S.C. § 119 to Korean Patent Application No. 10-2019-0134115, filed on Oct. 25, 2019, in the Korean Intellectual Property Office, the disclosure of which is incorporated by reference herein in its entirety.

BACKGROUND

1. Field

The disclosure relates to a display apparatus and an operating method thereof, and more particularly, to a display apparatus having improved uniformity between light-emitting devices included in the display apparatus, and an operating method of the display apparatus.

2. Description of Related Art

A light-emitting diode (LED) is a semiconductor light-emitting device which transforms electric energy into light energy. An LED display apparatus is a device which is driven by current and has a brightness that varies according to the magnitude of the current.

An LED display apparatus may include micro LEDs (μLEDs). A micro LED is an ultra-small LED having one tenth of a length and one hundredth of an area of a normal LED chip. For example, a micro LED may have a size of about 10 to about 100 micrometers (μm). A micro LED may have a higher response speed and lower power consumption, and may provide greater brightness than a standard LED. Also, when the micro LED is provided in a display and is bent, the micro LED does not break.

A micro LED display panel is a flat display panel that includes a plurality of inorganic LEDs each having a size less than or equal to 100 μm. Compared to a liquid crystal display (LCD) panel requiring backlight, the micro LED display panel provides a better contrast, a higher response rate, and greater energy efficiency. Both an organic LED (OLED) and a micro LED, which is an inorganic light-emitting device, have excellent energy efficiency. However, the micro LED has better emission efficiency and a greater life span than the OLED.

An EPI layer (Epitaxial wafer) is deposited on a wafer to form an LED. To provide a display by using the LED, chips on the wafer are cut one by one, and then, LEDs are taken by a stamp and transferred to a module. The LEDs transferred to the module are combined to form an LED display panel. In this case, due to differences in various processes, such as a varying temperature of the wafer or an irregular thickness of the layer, the chips may have different characteristics from each other. That is, the chips may have a color difference according to a deviation in a wavelength or a different brightness value according to an input current.

To calibrate the difference of characteristics between devices, chips that are cut may be electrically tested one by one, and LEDs may be classified into groups based on characteristics according to brightness or wavelength. Then, the LEDs having similar characteristics may be gathered and used together. However, in the case of the micro LED, the size thereof is too small as described above, and thus, it is difficult not only to cut the chips, but also to perform electrical tests on the chips that are cut. Also, even when the devices are classified into groups based on similar characteristics via electrical tests, when current is applied to the devices classified into the same group, the devices may have different characteristics. Thus, the different characteristics of each micro LED must be uniformly calibrated.

SUMMARY

Provided are a display apparatus including a plurality of pixels, the display apparatus being capable of calibrating colors and brightnesses of light-emitting devices included in pixels by adaptively selecting a calibration matrix for each pixel, and an operating method of the display apparatus.

Also provided is an apparatus for generating a calibration matrix for calibrating colors and brightnesses of light-emitting devices included in pixels.

According to an aspect of the disclosure, there is provided an apparatus for generating a calibration matrix, the apparatus including: a measurer configured to measure a brightness and a chromaticity for each light-emitting device of a plurality of light-emitting devices within a pixel; and a calibration matrix generator configured to obtain a target brightness for each light-emitting device of the plurality of light-emitting devices corresponding to a white target brightness and a white target chromaticity, and generate a plurality of calibration matrices for the pixel based on the target brightness for each light-emitting device of the plurality of light-emitting devices, a target chromaticity of a light-emitting device on which a chromaticity calibration is to be performed, and the measured brightness and the measured chromaticity for each light-emitting device of the plurality of light-emitting devices.

The calibration matrix generator may be further configured to obtain a variable target brightness for each light-emitting device of the plurality of light-emitting devices based on a measured chromaticity of a light-emitting device on which a brightness calibration is to be performed and the target chromaticity of the light-emitting device on which the chromaticity calibration is to be performed, and generate a white calibration matrix based on the variable target brightness.

The light-emitting device on which the brightness calibration is to be performed may correspond to a blue light-emitting diode (LED).

The calibration matrix generator may be further configured to obtain a fixed target brightness for each light-emitting device of the plurality of light-emitting devices based on a target chromaticity for each light-emitting device of the plurality of light-emitting devices, and generate a color calibration matrix from the fixed target brightness.

A target chromaticity of a blue light emitting diode (LED) may be obtained from measured chromaticities of a plurality of blue LEDs.

The measurer may be further configured to measure a plurality of brightnesses in a plurality of gradations including a low gradation and a high gradation, and the calibration matrix generator may be further configured to generate a white calibration matrix and a color calibration matrix for each gradation of the plurality of gradations based on the plurality of measured brightnesses in the plurality of gradations.

The calibration matrix generator may be further configured to generate an interpolation white calibration matrix by interpolating the white calibration matrix generated for each gradation of the plurality of gradations, and generate an interpolation color calibration matrix by interpolating the color calibration matrix generated for each of the plurality of gradations.

According to an aspect of the disclosure, there is provided, a display apparatus including: a display panel including a plurality of pixels, each pixel of the plurality of pixels having a plurality of light-emitting devices; a storage configured to store a plurality of calibration matrices for each pixel of the plurality of pixels; a processor configured to identify a calibration matrix according to input data of the plurality of pixels and to calibrate modulation data corresponding to the input data based on the identified calibration matrix; and a panel driver configured to drive the display panel by applying a driving signal generated from the calibrated modulation data to the light-emitting devices of the plurality of pixels, wherein the plurality of calibration matrices includes a white calibration matrix and a color calibration matrix.

The processor may be further configured to identify the white calibration matrix in response to the input data having a white gradation value, and identify the color calibration matrix in response to the input data having one of red, green, and blue gradation values.

When the input data does not have one of the white, red, green, and blue gradation values, the processor may be further configured to identify an interpolation matrix generated based on the white calibration matrix and the color calibration matrix, and calibrate the modulation data corresponding to the input data based on the interpolation matrix.

The plurality of calibration matrices may include a white calibration matrix and a color calibration matrix for a high gradation, and a white calibration matrix and a color calibration matrix for a low gradation, for each of the plurality of pixels, and the processor may be further configured to identify the calibration matrix according to whether a gradation value of the input data corresponds to the low gradation or the high gradation.

The processor may be further configured to identify an interpolation matrix generated based on the white calibration matrix and the color calibration matrix for the low gradation in response to the gradation value of the input data corresponding to the low gradation, and identify an interpolation matrix generated based on the white calibration matrix and the color calibration matrix for the high gradation in response to the gradation value of the input data corresponding to the high gradation.

According to an aspect of an example embodiment, there is provided a method of generating a calibration matrix, the method including: measuring a brightness and a chromaticity for each light-emitting device of a plurality of light-emitting devices within a pixel; obtaining a target brightness for each light-emitting device of the plurality of light-emitting devices based on a white target brightness and a white target chromaticity; and generating a plurality of calibration matrices for the pixel based on the target brightness for each light-emitting device of the plurality of light-emitting devices, a target chromaticity of a light-emitting device on which a chromaticity calibration is to be performed, and the measured brightness and the measured chromaticity for each light-emitting device of the plurality of light-emitting devices.

The obtaining of the target brightness for each of the plurality of light-emitting devices may include: obtaining a variable target brightness for each light-emitting device of the plurality of light-emitting devices based on a measured chromaticity of a light-emitting device on which a brightness calibration is to be performed and the target chromaticity of the light-emitting device on which the chromaticity calibration is to be performed; and obtaining a fixed target brightness for each of the plurality of light-emitting devices based on a target chromaticity for each of the plurality of light-emitting devices.

The generating of the plurality of calibration matrices may include: generating a white calibration matrix from the variable target brightness; and generating a color calibration matrix from the fixed target brightness.

The light-emitting device on which the brightness calibration is to be performed may correspond to a blue light-emitting diode (LED) device.

A target chromaticity of the blue LED may be obtained from measured chromaticities of a plurality of blue LEDs.

The measuring the brightness for each of the plurality of light-emitting devices may include measuring a plurality of brightnesses in a plurality of gradations including a low gradation and a high gradation, and the generating of the plurality of calibration matrices may include generating a white calibration matrix and a color calibration matrix for each of the plurality of gradations, based on the plurality of measured brightnesses in the plurality of gradations.

According to an aspect of the disclosure, there is provided display method including: identifying a calibration matrix from among a plurality of calibration matrices corresponding to input data of a pixel having a plurality of light-emitting devices; calibrating modulation data corresponding to the input data based on the identified calibration matrix; and driving a display panel by applying a driving signal generated from the calibrated modulation data to the plurality of light-emitting devices of the pixel, wherein the plurality of calibration matrices includes a white calibration matrix and a color calibration matrix.

The identifying of the calibration matrix may include: identifying the white calibration matrix in response to the input data having a white gradation value; and identifying the color calibration matrix in response to the input data having one of red, green, and blue gradation values.

The display method may further include, in response to the input data not having one of white, red, green, and blue gradation values, generating an interpolation matrix based on the white calibration matrix and the color calibration matrix, and the identifying of the calibration matrix further may include identifying the generated interpolation matrix in response to the input data not having one of white, red, green, and blue gradation values.

The plurality of calibration matrices may include a white calibration matrix and a color calibration matrix for a high gradation and a white calibration matrix and a color calibration matrix for a low gradation, for each of the light-emitting devices, and the identifying of the calibration matrix may include identifying the calibration matrix according to whether a gradation value of the input data corresponds to the low gradation or the high gradation.

The display method may further include: in response to the gradation value of the input data corresponding to the low gradation, identifying an interpolation matrix generated based on the white calibration matrix and the color calibration matrix for the low gradation; and in response to the gradation value of the input data corresponding to the high gradation, identifying an interpolation matrix generated based on the white calibration matrix and the color calibration matrix for the high gradation.

According to an aspect of an embodiment, there is provided, a non-transitory computer-readable recording medium storing a computer program which is executed by a computing device to perform a display method, the method including: identifying a calibration matrix from among a plurality of calibration matrices corresponding to input data of a pixel having a plurality of light-emitting devices; calibrating modulation data corresponding to the input data based on the identified calibration matrix; and driving a display panel by applying, to the plurality of light-emitting devices of the pixel, a driving signal generated from the calibrated modulation data, wherein the plurality of calibration matrices may include a white calibration matrices and a color calibration matrices.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
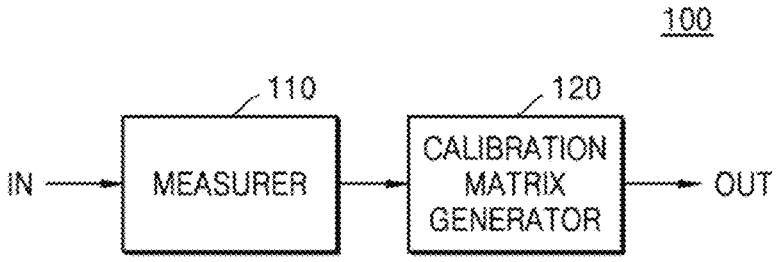
FIG. 1 is a block diagram of an internal structure of an apparatus for generating a calibration matrix according to an embodiment.

Hereinafter, embodiments of the disclosure will be described in detail with reference to the accompanying drawings so that one of ordinary skill in the art could easily execute the disclosure. However, the disclosure may have different forms and should not be construed as being limited to the embodiments of the disclosure described herein.

The terms used in the disclosure are selected from among common terms that are currently widely used in consideration of their function in the disclosure. However, the terms may be different according to an intention of one of ordinary skill in the art, a precedent, or the advent of new technology. Therefore, the terms used in the disclosure are not merely designations of the terms, but the terms are defined based on the meaning of the terms and content throughout the disclosure.

Also, the terms used in the disclosure are merely used to describe one or more embodiments of the disclosure and do not intend to limit the disclosure.

Throughout the specification, when a part is referred to as being "connected" to other parts, the part may be "directly connected" to the other parts or may be "electrically connected" to the other parts with other devices therebetween.

The term "the" and similar demonstratives that are used in this specification, in particular in the claims, may refer to both a singular form and a plural form. Also, unless there is a description clearly defining an order of operations of a method according to the disclosure, the operations may be performed in appropriate orders. The disclosure is not limited to a described order of the operations.

The expression "in some embodiments" or "according to an embodiment" used in this specification does not necessarily refer to the same embodiments of the disclosure.

The embodiments of the disclosure may be indicated as functional block components and various processing operations. The functional blocks may be implemented as various numbers of hardware and/or software components performing specific functions. For example, the functional blocks of the disclosure may be implemented by one or more microprocessors or by circuit configurations for certain functions. Also, for example, the functional blocks of the disclosure may be implemented by various programming or scripting languages. The functional blocks may be implemented as algorithms executed by one or more processors. Also, the disclosure may adopt the related art for setting of electronic environments, processing of signals, and/or processing of data. The terms "mechanisms," "elements," and "devices" may be broadly used and may not be limited to mechanical and physical components.

Also, connecting lines or connecting members between components illustrated in the drawings are examples of functional connection and/or physical or circuital connection. In an actual device, components may be connected via various functional connections, physical connections, and circuital connections which are to be replaced or to be added.

Throughout the disclosure, the expression "at least one of a, b or c" indicates only a, only b, only c, both a and b, both a and c, both b and c, all of a, b, and c, or variations thereof.

The terms described in the specification, such as "unit," "module," etc., denote a unit processing at least one function or operation, which may be implemented as hardware or software or a combination thereof.

The term "user" in one or more embodiments of the disclosure may include a manufacturer, a producer, or an inspector of a calibration matrix generating device or a display apparatus, or a manger, an installing technician, a user, or a viewer controlling a function or an operation of the calibration matrix generating device or the display apparatus.

Hereinafter, the disclosure will be described in detail by referring to the accompanying drawings.

FIG. 1 is a block diagram of an internal structure of an apparatus 100 for generating a calibration matrix according to an embodiment.

Referring to FIG. 1, the apparatus 100 for generating the calibration matrix may include a measurer 110 and a calibration matrix generator 120.

Light-emitting devices included in a display apparatus may have characteristics that are not the same as one another for various reasons. Light-emitting diodes (LEDs) may have wavelength differences caused by temperature differences of wafers or layers in a manufacturing process. Thus, the LEDs may have process distributions, caused by changes in colors that are output, or differences in the quality of layers or the thickness of the wafers. Also, the brightness and the chromaticity of each of light-emitting devices may not be the same due to various reasons, such as changes in the brightness or the chromaticity of an LED display due to heating states of LED modules, or the gamma calibration that is performed by measuring a plurality of devices altogether.

Also, the LEDs have a brightness that varies according to the current, and the brightness and the color of the LEDs may also be changed due to the characteristics of the LEDs. Because each LED has unique characteristics and an intrinsic resistance value, for each color, a brightness change based on a current change may become different between the LEDs, even when the same current and the same voltage are applied to the LEDs. Also, a color coordinate of each LED in a chromaticity space may be changed in a different way according to an increase in the current, so that each LED has different color shift characteristics from each other. For example, when the LEDs include a red LED and a blue LED, x and y coordinates may maintain approximately constant values according to an increase in the current. However, when the LEDs include a green LED, x and y coordinates may be significantly changed according to an increase in the current. Distributions of measured chromaticity of a certain LED will be described with reference to FIG. 2.

Figure 2:
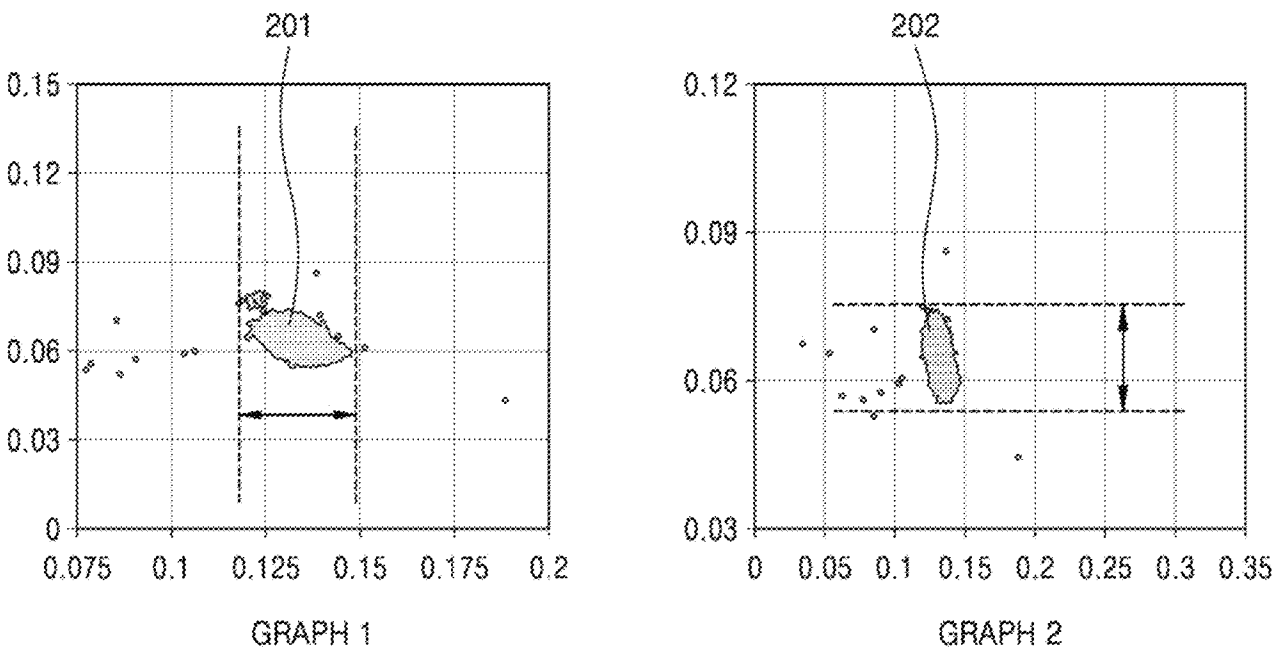
FIG. 2 shows graphs of distributions of measured chromaticity.

FIG. 2 shows graphs of distributions of measured chromaticity. Referring to FIG. 2, the graphs show distributions of a light-emitting device before a color of the light-emitting device is calibrated. Horizontal axes of the graphs are X-axes and vertical axes of the graphs are Y-axes. The distributions of the graphs may be indicated as a color coordinate of x, y.

Each of an area 201 indicated in graph 1 and an area 202 indicated in graph 2 indicates a distribution/spread of the light-emitting device that is measured. When a light-emitting device does not have a wavelength distribution, the area of the light-emitting device on the graph may be concentrated toward a target point on the graph.

Graph 1 shows a case in which the measured light-emitting device has a large distribution in the X-axis, and graph 2 shows a case in which the measured light-emitting device has a large distribution in the Y-axis. As shown in graph 1 and graph 2, the light-emitting device has the wavelength distributions in both the X-axis and the Y-axis.

Light-emitting devices may have wavelength distributions based on various factors, and thus, calibration may be performed to reduce the wavelength distributions. The calibration may denote a process of calibration of data with respect to a light-emitting device. Calibrating the data may denote a process performed by a display apparatus to minimize a difference of colors and/or brightnesses between pixels and light-emitting devices included in the pixel.

Each of the light-emitting devices may have a different wavelength distribution, and thus, to calibrate a chromaticity and/or a brightness of each light-emitting device having different characteristics, a calibration suitable for each light-emitting device may be performed.

Referring to FIG. 1 again, a display apparatus may use a calibration matrix for each of pixels to calibrate a difference of colors and/or brightnesses between light-emitting devices included in the pixels, in order to calibrate data with respect to each of the light-emitting devices.

A display panel included in the display apparatus may include a plurality of pixels. Each of the pixels may include a plurality of light-emitting devices, such as LEDs. That is, each pixel may include a red LED, a green LED, and a blue LED. A calibration matrix may be a matrix which contains information about a coordinate movement value in a chromaticity diagram and/or a brightness ratio that is to be changed, with respect to each light-emitting device, as a coefficient value, in order to make light-emitting devices included in one pixel have the same color and the same brightness as light-emitting devices included in another pixel. The display apparatus may use the calibration matrix to calibrate first modulation data with respect to input data.

According to an embodiment, the apparatus 100 for generating the calibration matrix may be an apparatus generating the calibration matrix, which is to be used by the display apparatus, for each pixel.

The measurer 110 may include a camera or an image sensor. In FIG. 1, an input signal IN that is input to the measurer 110 may be information about the light-emitting devices. The measurer 110 may capture light emitted from the light-emitting devices included in the display panel. The measurer 110 may obtain images about the plurality of light-emitting devices by capturing light emitted from the light-emitting devices included in the display panel. The measurer 110 may measure the brightness and/or the chromaticity for each light-emitting device from the obtained images. One pixel may include a red LED, a green LED, and a blue LED, and thus, the measurer 110 may measure the chromaticity and/or the brightness of each of the LEDs, to obtain a measured brightness and/or a measured chromaticity.

According to an embodiment, the measurer 110 may measure the brightness and/or the chromaticity for each light-emitting device a number of times. The light-emitting device may have different brightness characteristics between cases of high gradation and low gradation. That is, a brightness deviation may occur between the gradations, and thus, the measurer 110 may measure a brightness value for each light-emitting device according to different gradation values. For example, based on a certain reference gradation, the measurer 110 may measure a brightness value in a low gradation value which is less than the reference gradation and a brightness value in a high gradation value which is greater than the reference gradation.

According to an embodiment, the calibration matrix generator 120 may generate a plurality of calibration matrices for each pixel. The calibration matrix generator 120 may obtain a target brightness for each light-emitting device included in a pixel, in order to generate a white target brightness and a white target chromaticity. That is, the calibration matrix generator 120 may calculate whichever brightness has to be provided by each of the red LED, the green LED, and the blue LED, in order to obtain the white target brightness and the white target chromaticity of one pixel. The calibration matrix generator 120 may generate the calibration matrix per a unit of a pixel, by using the target brightness obtained with respect to each light-emitting device.

According to an embodiment, the calibration matrix generator 120 may obtain a plurality of target brightnesses satisfying the white target brightness and the white target chromaticity.

According to an embodiment, the calibration matrix generator 120 may generate the target brightness for each light-emitting device by using the measured chromaticity for a light-emitting device on which brightness calibration is to be performed, and by using a target chromaticity for a light-emitting device on which chromaticity calibration is to be performed, from among the light-emitting devices included in a pixel. Here, the generated target brightness may have a variable value, because the measured chromaticities of the light-emitting devices on which the brightness calibration is to be performed may be different between the light-emitting devices. Hereinafter, the target brightness having the variable value will be referred to as a variable target brightness. The calibration matrix generator 120 may generate a first calibration matrix by using the variable target brightness. According to an embodiment, the first calibration matrix may be a white calibration matrix which is used when the input data is white, that is, when a gradation value of the input data is 255, 255, 255.

According to an embodiment, the calibration matrix generator 120 may generate the target brightness by using a fixed target chromaticity for all of the light-emitting devices included in a pixel. Here, the generated target brightness may have a fixed value, because the generated target brightness is obtained by using the same fixed target chromaticity, rather than the target chromaticity having a different value for each light-emitting device. Here, the target brightness having the fixed value will be referred to as a fixed target brightness. The calibration matrix generator 120 may generate a second calibration matrix by using the fixed target brightness. According to an embodiment, the second calibration matrix may be a color calibration matrix, which is used when the input data is a red, green, or blue image, rather than a white image.

According to an embodiment, the calibration matrix generator 120 may generate a different calibration matrix for each gradation by using the measured brightness obtained by the measurer 110 for each light-emitting device in a plurality of gradations. The calibration matrix generator 120 may generate a white calibration matrix and a color calibration matrix for each gradation by using the plurality of measured brightnesses. For example, the calibration matrix generator 120 may obtain a measured brightness of the light-emitting device in the low gradation. Also, the calibration matrix generator 120 may use the measured brightness of the light-emitting device in the low gradation to generate a white calibration matrix of the low gradation and a color calibration matrix of the low gradation. Similarly, the calibration matrix generator 120 may obtain a measured brightness of the light-emitting device in the high gradation. Also, the calibration matrix generator 120 may use the measured brightness of the light-emitting device in the high gradation to generate a white calibration matrix of the high gradation and a color calibration matrix of the high gradation.

Similarly, the calibration matrix generator 120 may use a measured brightness of the light-emitting device, which is obtained in an intermediate gradation between the high and low gradations, to generate a white calibration matrix of the intermediate gradation and a color calibration matrix of the intermediate gradation. Alternatively, the calibration matrix generator 120 may generate the white calibration matrix of the intermediate gradation and the color calibration matrix of the intermediate gradation by interpolating the calibration matrix obtained with respect to each of the high gradation and the low gradation.

The calibration matrix generator 120 may output the plurality of calibration matrices as an output signal OUT. The plurality of calibration matrices generated by the calibration matrix generator 120 may be transmitted to the display apparatus through a communication network or may be stored in the display apparatus in the form of data recorded on a storage medium.

Figure 3:
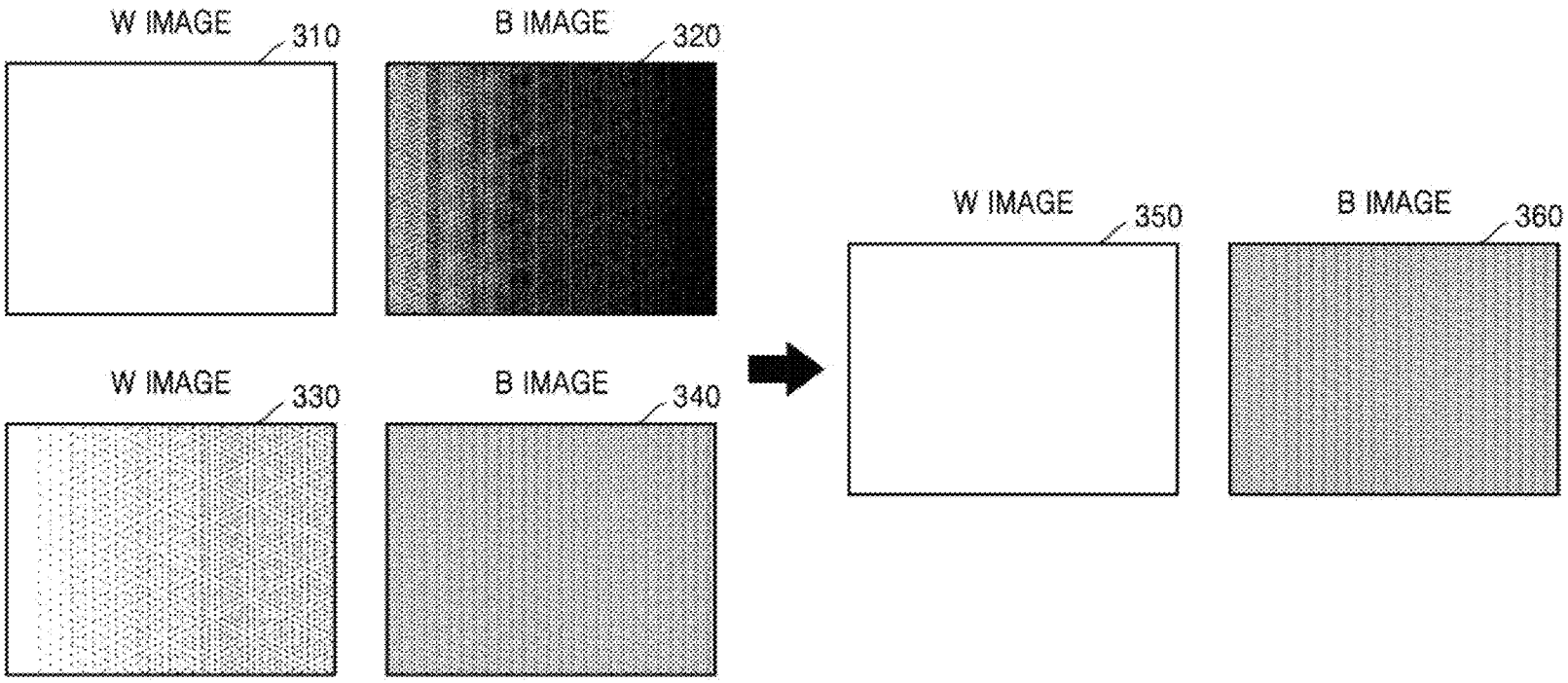
FIG. 3 is a diagram comparing a white color temperature and a blue brightness based on a blue wavelength distribution of an output image showing a case in which an appropriate calibration matrix is not applied to each piece of data of an input image and a case in which an appropriate calibration matrix is applied to each piece of data of an input image, according to an embodiment.

FIG. 3 is a diagram for comparing a white color temperature and a blue brightness according to a blue wavelength distribution of an output image showing a case in which a calibration matrix which is appropriate for each input image is not applied and a case in which a calibration matrix which is appropriate for each input image is applied according to an embodiment.

Upper left images 310 and 320 and lower left images 330 and 340 of FIG. 3 show that deviations in the white color temperature and the blue brightness occur in the output image due to the blue wavelength distribution, when the input image is not calibrated by using appropriate calibration matrices.

According to an embodiment, the apparatus 100 for generating the calibration matrix may generate the calibration matrix appropriate for the input image for each data gradation of the input image. According to an embodiment, the apparatus 100 for generating the calibration matrix may generate a white calibration matrix to be applied when the data gradation of the input image corresponds to a white image and a blue calibration matrix to be applied when the data gradation of the input image corresponds to a blue image.

In FIG. 3, a first image 310 and a second image 320 illustrate output images generated by applying the white calibration matrix to different input images.

The first image 310 shows an image, which is output from a display apparatus when the white calibration matrix is applied to an input image, which has a white gradation value, that is, a data value of 255, 255, 255 corresponding to a white image. The first image 310 shows a uniform white color temperature. That is, the first image 310 shows that when the white calibration matrix is applied to the white image, the white color temperature is uniformly calibrated.

The second image 320 shows an image, which is output when the white calibration matrix is applied to an input image, which has a blue gradation value, that is, a data value of 0, 0, 255. The second image 320 shows that the blue color has a brightness difference due to a wavelength distribution. That is, it is shown that when the white calibration matrix is applied to a blue image, the brightness of the blue image is not uniformly calibrated and the brightness difference occurs.

In FIG. 3, a third image 330 and a fourth image 340 show output images generated by applying a blue calibration matrix to different input images.

The third image 330 shows an image, which is output from the display apparatus when an input image, which has a white gradation value, is calibrated by applying the blue calibration matrix. The third image 330 shows that when the blue calibration matrix is applied to the white image, the white image that is output has a color temperature deviation.

The fourth image 340 shows an image, which is output when an input image, which has a blue gradation value, is calibrated by applying the blue calibration matrix. The fourth image 340 shows that when the blue calibration matrix is applied to the blue image, the brightness of the blue image is uniformly calibrated.

As described above, when the same calibration matrix is applied to input images that are different from each other, a color, a brightness, or a color temperature is calibrated well for a certain input image, but the same is not calibrated well and a distribution occurs for other input images.

According to an embodiment, the apparatus 100 for generating the calibration matrix may generate a plurality of calibration matrices for each pixel. According to an embodiment, the display apparatus may select a calibration matrix which is appropriate for an input image, from among the plurality of calibration matrices, and may calibrate the input image by using the selected calibration matrix.

In a right side of FIG. 3, a fifth image 350 shows an output image when the display apparatus selects and applies a white calibration matrix to a white input image, according to an embodiment, and a sixth image 360 shows an output image when the display apparatus applies a blue calibration matrix to a blue input image, according to an embodiment. The right side of FIG. 3 shows that a color temperature difference or a brightness deviation is calibrated well for both of the fifth image 350, which is the white image, and the sixth image 360, which is the blue image.

Figure 4:
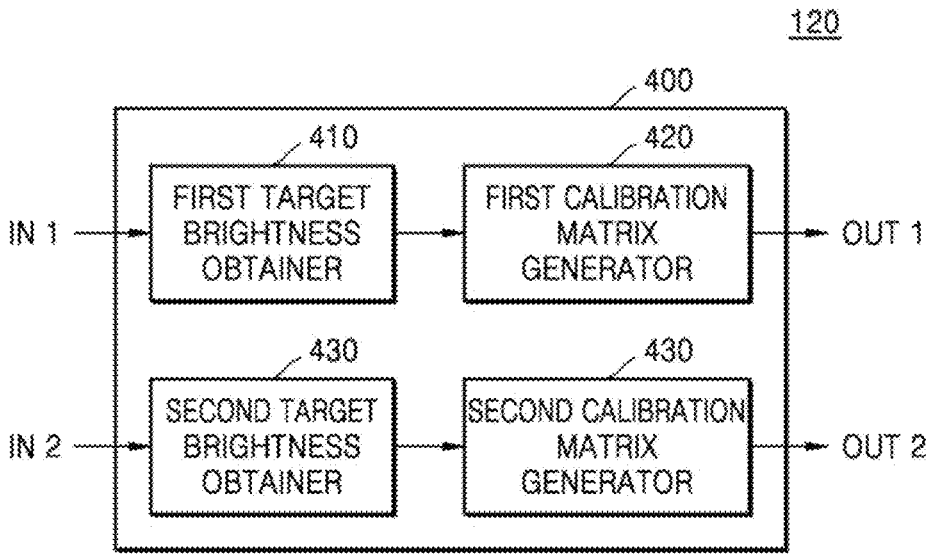
FIG. 4 is a block diagram of an internal structure of a calibration matrix generator according to an embodiment.

FIG. 4 is a block diagram of an internal structure of the calibration matrix generator 120 according to an embodiment.

According to an embodiment, the calibration matrix generator 120 may generate a plurality of calibration matrices for each pixel.

To this end, the calibration matrix generator 120 may include a plurality of target brightness obtainers, and a plurality of calibration matrix generators configured to generate calibration matrices based on a target brightness obtained by each of the target brightness obtainers.

In FIG. 4, the calibration matrix generator 120 may include a first target brightness obtainer 410, a first calibration matrix generator 420, a second target brightness obtainer 430, and a second calibration matrix generator 440. However, this is only an example embodiment, and the calibration matrix generator 120 may include additional target brightness obtainers and additional calibration matrix generators.

The first target brightness obtainer 410 may receive a brightness and a chromaticity measured from the measurer 110 for each light-emitting device included in a display apparatus and a target chromaticity for each light-emitting device, as input data IN1. The second target brightness obtainer 430 may also receive the measured brightness and the measured chromaticity for each light-emitting device and the target chromaticity for each light-emitting device, as input data IN2.

According to an embodiment, the first target brightness obtainer 410 and the second target brightness obtainer 430 may obtain the target brightnesses from the input data IN1 and IN2, respectively. The first target brightness obtainer 410 and the second target brightness obtainer 430 may obtain, based on Equation 1 below, the target brightness for each light-emitting device, the target brightness satisfying a white target brightness and a white target chromaticity.

$$\begin{bmatrix} X_{tgtW} \\ Y_{tgtW} \\ Z_{tgtW} \end{bmatrix} = \begin{bmatrix} x_{tgtR}/y_{tgtR} & x_{tgtG}/y_{tgtG} & x_{tgtB}/y_{tgtB} \\ 1 & 1 & 1 \\ z_{tgtR}/y_{tgtR} & z_{tgtG}/y_{tgtG} & z_{tgtB}/y_{tgtB} \end{bmatrix} \begin{bmatrix} Y_{tgtR} \\ Y_{tgtG} \\ Y_{tgtB} \end{bmatrix} \quad (1)$$

In Equation 1, $X_{tgtw}$, $Y_{tgtw}$, $Z_{tgtw}$ on the left side indicate the white target brightness and the white target chromaticity. $Y_{tgtR}$, $Y_{tgtG}$, $Y_{tgtB}$ on the right side indicate the target brightness for each light-emitting device for generating the white target brightness and the white target chromaticity. A 3×3 matrix of Equation 1 may be obtained by using the target chromaticity for each light-emitting device. The target chromaticity included in the matrix is indicated as a color coordinate value of x, y, z. The matrix of Equation 1 indicates which brightness each light-emitting device (such as, a red LED, a green LED, and a blue LED) may have to provide, when the white target brightness and the white target chromaticity are given, and the target chromaticity for each light-emitting device are given.

According to an embodiment, when the first target brightness obtainer 410 and the second target brightness obtainer 430 obtain, based on Equation 1, the target brightness for each light-emitting device for achieving the white target chromaticity and the white target brightness that are fixed, the first and second target brightness obtainers 410 and 430 may use different values.

According to an embodiment, the first target brightness obtainer 410 and the second target brightness obtainer 430 may differently obtain the target brightness for each light-emitting device, by using different values from each other as the target chromaticity for each light-emitting device included in the matrix.

According to an embodiment, the first target brightness obtainer 410 may use a target chromaticity of a light-emitting device, on which chromaticity calibration is to be performed, from among the light-emitting devices, as the target chromaticity for each light-emitting device included in the matrix. Also, according to an embodiment, for a light-emitting device on which brightness calibration is to be performed from among the light-emitting devices, the first target brightness obtainer 410 may use a measured chromaticity with respect to the light-emitting device, rather than the target chromaticity.

According to an embodiment, whether chromaticity calibration or brightness calibration is to be performed on the light-emitting devices may be determined based on colors of the light-emitting devices.

Human eyes are sensitive to changes in a blue color. As described above, the calibration matrix has values for moving a coordinate value of each light-emitting device in a chromaticity diagram to one identical target value. Moving the coordinate value may include mixing other colors with a corresponding color. When a coordinate value of the blue color is moved to a target value by using a calibration matrix for performing chromaticity calibration on the blue color, the coordinate value in the chromaticity diagram may be moved to a target coordinate value by mixing a red color and a green color with the blue color. However, when the coordinate value of the blue color is changed by applying the calibration matrix to the blue color, the red color and the green color mixed with the blue color may not be mixed well with the blue color and may be recognized and viewed as noises. That is, when the blue color is mixed with other colors, human eyes may recognize the red and green colors as noises.

According to an embodiment, by taking into account this characteristics of the blue color, a calibration matrix whereby chromaticity calibration is not performed on a blue LED and only brightness calibration is performed on the blue LED, may be generated.

According to an embodiment, whether chromaticity calibration or brightness calibration is to be performed on the light-emitting devices may be determined based on wavelength distributions of the light-emitting devices. For example, when a measured chromaticity of a green LED is different than a certain reference value, for example, an average value of measured chromaticities of all of green LEDs included in a panel, by a value equal to or greater than a threshold value, the chromaticity calibration, in addition to the brightness calibration, may have to be performed on the green LED.

According to an embodiment, only the brightness calibration may have to be performed on a light-emitting device which does not have a large wavelength distribution. For example, when a measured chromaticity of a red LED is not different than a certain reference value, for example, an average value of measured chromaticities of a plurality of red LEDs included in a display panel, by a value that is equal to or greater than a threshold value, a calibration matrix for performing only the brightness calibration on the red LED may be generated.

According to an embodiment, when the first target brightness obtainer 410 obtains the target chromaticity for each light-emitting device included in the matrix, the first target brightness obtainer 410 may use the target chromaticity for a light-emitting device on which chromaticity calibration is to be performed and use the measured chromaticity, rather than the target chromaticity, for a light-emitting device on which brightness calibration is to be performed. For example, when the wavelength distributions measured from the red LEDs and the green LEDs are large, the first target brightness obtainer 410 may input target chromaticities xtgtR, ytgtR, ztgtR xtgtG, ytgtG, and ztgtG of the red LEDs and the green LEDs into the matrix.

As described above, when chromaticity calibration is to be performed on the blue color, the red or green color may not be mixed well and may be viewed as noises. To solve this problem, according to an embodiment, the first calibration matrix generator 420 may generate a calibration matrix for not performing chromaticity calibration and performing only brightness calibration on the blue LED. To this end, the first target brightness obtainer 410 may use the measured chromaticities of the blue LEDs, rather than the target chromaticity of the blue color, as the chromaticities xtgtB, ytgtB, and ztgtB related to the blue color included in the matrix. The chromaticity of the blue color measured with respect to the blue LED included in each pixel may be different from each other. Thus, in the matrix of Equation 1, the chromaticity of the blue color measured for each blue LED is used, rather than a fixed chromaticity of a blue LED that is subject to calibration. Thus, a target brightness $Y_{tgtR}$, $Y_{tgtG}$, and $Y_{tgtB}$ for each light-emitting device for obtaining the white target brightness/chromaticity may also have a variable value depending on each light-emitting device.

Dissimilarly, according to an embodiment, the second target brightness obtainer 430 may use a target chromaticity of all of light-emitting devices, for obtaining the matrix. The second target brightness obtainer 430 may input one fixed target chromaticity with respect to not only the red LEDs and the green LEDs, but also the blue LEDs, for obtaining the matrix of Equation 1. That is, the second target brightness obtainer 430 may obtain the target brightness by inputting the fixed target chromaticities of the red LEDs, the green LEDs, and the blue LEDs with respect to xtgtR, ytgtR, ztgtR xtgtG, ytgtG, ztgtG, xtgtB, ytgtB, and ztgtB of the matrix.

According to an embodiment, in the case of the blue color, an average value of measured chromaticities of all of the blue LEDs included in a display panel may be used as a fixed target chromaticity. Alternatively, a fixed target chromaticity with respect to the blue color may be pre-determined. The second target brightness obtainer 430 may obtain the target brightness $Y_{tgtR}$, $Y_{tgtG}$, and $Y_{tgtB}$ for each light-emitting device for obtaining the white target brightness and the white target chromaticity, by using the matrix having a fixed value. Here, the target brightness for each light-emitting device $Y_{tgtR}$, $Y_{tgtG}$, and $Y_{tgtB}$ may also be obtained as a fixed value.

According to an embodiment, the first calibration matrix generator 420 and the second calibration matrix generator 440 may respectively generate a first calibration matrix and a second calibration matrix by respectively using the target brightness obtained by the first target brightness obtainer 410 and the target brightness obtained by the second target brightness obtainer 430.

Each of the first calibration matrix generator 420 and the second calibration matrix generator 440 may generate the calibration matrix based on Equation 2 below.

$$\begin{bmatrix} R \\ G \\ B \end{bmatrix} = \begin{bmatrix} w_{rr} & w_{rg} & w_{rb} \\ w_{gr} & w_{gg} & w_{gb} \\ w_{br} & w_{bg} & w_{bb} \end{bmatrix} \begin{bmatrix} R_i \\ G_i \\ B_i \end{bmatrix} \tag{2}$$

In Equation 2, RI GI Bi on the right side are data to which the calibration matrix is applied and R, G, B on the left side indicates values calibrated by applying the calibration matrix to the RI GI Bi. The 3×3 matrix of Equation 2 may be a calibration matrix having values for calibrating the chromaticity and/or the brightness of each light-emitting device. A coefficient value, $w_{xy}$, included in the calibration matrix may indicate a value or a rate, with which x has to be turned on in order to calibrate a color of y.

According to an embodiment, the first calibration matrix generator 420 may generate a first calibration matrix for performing chromaticity calibration on the red LED and the green LED included in each pixel and performing brightness calibration on the blue LED included in each pixel. To this end, the first calibration matrix generator 420 may obtain $w_{rg}$, $w_{gg}$, $w_{bg}$ in Equation 2 by using Equation 3 below.

$$\begin{bmatrix} w_{rg} \\ w_{gg} \\ w_{bg} \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X_{tgtG} \\ Y_{tgtG} \\ Z_{tgtG} \end{bmatrix} \tag{3}$$

In Equation 3, $X_{tgtG}$, $Z_{tgtG}$ on the right side indicates a target chromaticity of the green LED and $Y_{tgtG}$ indicates a target brightness of the green LED for achieving a white target brightness and a white target chromaticity. The values included in the matrix of Equation 3 are the measured brightness and the measured chromaticity for each light-emitting device. For example, $X_R$, $Y_R$, $Z_R$ included in the matrix indicate a measured brightness and a measured chromaticity of the red LED. As described above, the first target brightness obtainer 410 may obtain a variable target brightness depending on each light-emitting device, and thus, the target brightness $Y_{tgtG}$ used by the first calibration matrix generator 420 in Equation 3 may have a variable value.

The first calibration matrix generator 420 may obtain $w_{rg}$, $w_{gg}$, $w_{bg}$ from the variable target brightness of the green LED, $Y_{tgtG}$, the target chromaticities of the green LED, $X_{tgtG}$, $Z_{tgtG}$, and the measured brightness and the measured chromaticity for each light-emitting device. Based on substantially the same method, the first calibration matrix generator 420 may obtain $w_{rr}$, $w_{gr}$, $w_{br}$ of Equation 2.

According to an embodiment, the first calibration matrix generator 420 may generate a calibration matrix for performing only brightness calibration on the blue color. As described above, in the blue color, the red color or the green color may be seen as noises when chromaticity calibration, in which the red and the green colors are mixed with the blue color, is performed. Thus, according to an embodiment, the chromaticity calibration may not be performed and only the brightness calibration may be performed on the blue LED. When only the brightness calibration is performed on the blue LED, the brightness may be uniformly calibrated although the colors are different, and thus, human eyes may not recognize a large difference.

To this end, the first calibration matrix generator 420 may set $w_{rb}$, $w_{gb}$, which indicates the values, by which the red and green colors have to be turned on for the blue color, as 0. The first calibration matrix generator 420 may generate the calibration matrix for performing only the brightness calibration on the blue LED by using $w_{bb}=Y_{tgtB}/Y_B$ in Equation 2. $w_{bb}$ is a ratio between the target brightness of the blue LED $Y_{tgtB}$ and the measured brightness of the blue LED $Y_B$ and may be used to change the measured brightness to the target brightness.

According to another embodiment, the first calibration matrix generator 420 may generate a calibration matrix for performing the chromaticity calibration only on the green LED and performing only the brightness calibration on the red LED like the blue LED. In this case, the first calibration matrix generator 420 may generate the calibration matrix for performing only the brightness calibration on the red LED by using $w_{gr}$, $w_{br}$ having the value of 0 and $w_{rr}=Y_{tgtR}/Y_R$ of Equation 2. Alternatively, the first calibration matrix generator 420 may generate a calibration matrix for performing the chromaticity calibration only on the red LED and performing the brightness calibration on the green LED and the blue LED.

The first calibration matrix generator 420 may generate the calibration matrix of Equation 2 by using the obtained $w_{rr}$, $w_{gr}$, $w_{br}$, $w_{rg}$, $w_{gg}$, $w_{bg}$, $w_{rb}$, $w_{gb}$, and $w_{bb}$. The calibration matrix generated by the first calibration matrix generator 420 will be referred to as a first calibration matrix for convenience of explanation.

According to an embodiment, the first calibration matrix may be used for brightness and/or chromaticity calibration of a white image, when input data that is input to a display apparatus is the white image. Hereinafter, the first calibration matrix will have the same meaning as the white calibration matrix.

According to an embodiment, the second calibration matrix generator 440 may generate a calibration matrix by using the target brightness obtained by the second target brightness obtainer 430. The second calibration matrix generator 440 may also use Equation 3 to generate the calibration matrix of Equation 2. According to an embodiment, the second calibration matrix generator 440 may use a fixed target brightness rather than a variable target brightness, when using Equation 3, unlike the first calibration matrix generator 420.

As described above, the second target brightness obtainer 430 may obtain the target brightness for each light-emitting device $Y_{tgtR}$, $Y_{tgtG}$, $Y_{tgtB}$, the target brightness being used for obtaining the white target brightness and the white target chromaticity by using one fixed target chromaticity, not only for the red and green LEDs, but also for the green LED. Thus, the target brightness for each light-emitting device may have a fixed value.

Unlike the first calibration matrix generator 420, the second calibration matrix generator 440 may obtain $w_{rg}$, $w_{gg}$, $w_{bg}$ from Equation 3 by using the fixed target brightness obtained by the second target brightness obtainer 430. That is, the second calibration matrix generator 440 may obtain $w_{rg}$, $w_{gg}$, $w_{bg}$ from the fixed target brightness of the green LED, the target chromaticity of the green LED, and the measured brightness and the measured chromaticity for each light-emitting device in Equation 3. Based on substantially the same method, the second calibration matrix generator 440 may obtain $w_{rr}$, $w_{gr}$, $w_{br}$ of Equation 2.

According to an embodiment, the second calibration matrix generator 440 may also generate a calibration matrix for performing only brightness calibration on the blue LED. The second calibration matrix generator 440 may generate the calibration matrix for performing only the brightness calibration on the blue LED by using $w_{gr}$, $w_{br}$ having the value of 0 and $w_{rr}=Y_{tgtR}/Y_R$ of Equation 2. Alternatively, according to an embodiment of the disclosure, the second calibration matrix generator 440 may generate a calibration matrix for performing the chromaticity calibration only on the red LED and performing the brightness calibration on the blue LED and the green LED, or a calibration matrix for performing the chromaticity calibration only on the green LED and performing the brightness calibration on the blue LED and the red LED. The calibration matrix generated by the second calibration matrix generator 440 will be referred to as a second calibration matrix for convenience of explanation.

According to an embodiment, the second calibration matrix may be used for brightness and/or chromaticity calibration of a red, green, or blue image, when input data that is input to a display apparatus is the red, green, or blue image. The second calibration matrix may have one fixed target brightness with respect to all of the light-emitting devices, and thus, the red, green, and blue images calibrated by the second calibration matrix may have the uniform brightness.

Hereinafter, the second calibration matrix will have the same meaning as the color calibration matrix.

Although it is not shown in the example embodiment of FIG. 4, the calibration matrix generator 120 may include additional target brightness obtainers and additional calibration matrix generators.

According to an embodiment, the calibration matrix generator 120 may generate a calibration matrix to be used when an input image is not a white, red, green, or blue image. To this end, the calibration matrix generator 120 may generate an intermediate color interpolation matrix by interpolating the white calibration matrix and the color calibration matrix.

According to an embodiment, the calibration matrix generator 120 may generate a calibration matrix for each gradation of the light-emitting device. For example, when the measurer 110 measures a brightness for each light-emitting device in a low gradation and a high gradation, the calibration matrix generator 120 may generate a low gradation calibration matrix and a high gradation calibration matrix by respectively using the measured brightness for each light-emitting device that is measured in the low gradation and the measured brightness for each light-emitting device that is measured in the high gradation.

Specifically, the first calibration matrix generator 420 may generate the calibration matrix by using Equation 3, wherein the measured values of the matrix of Equation 3 correspond to different values between the low gradation and the high gradation. Thus, the first calibration matrix generator 420 may generate a low gradation first calibration matrix by using the measured brightness in the low gradation and a high gradation first calibration matrix by using the measured brightness in the high gradation.

Similarly, the second calibration matrix generator 440 may generate a low gradation second calibration matrix by using the measured brightness in the low gradation and a high gradation second calibration matrix by using the measured brightness in the high gradation.

According to an embodiment, the first calibration matrix generator 420 may generate an intermediate gradation first calibration matrix by interpolating the low gradation first calibration matrix and the high gradation first calibration matrix. Also, according to an embodiment, the second calibration matrix generator 440 may generate an intermediate gradation second calibration matrix by interpolating the low gradation second calibration matrix and the high gradation second calibration matrix.

The first calibration matrix generator 420 and the second calibration matrix generator 440 may output the calibration matrices generated for each pixel as output data OUT1 and OUT2. The output data may be transmitted to a display apparatus through a communication network or may be stored in a storage medium and used by the display apparatus.

Figure 5:
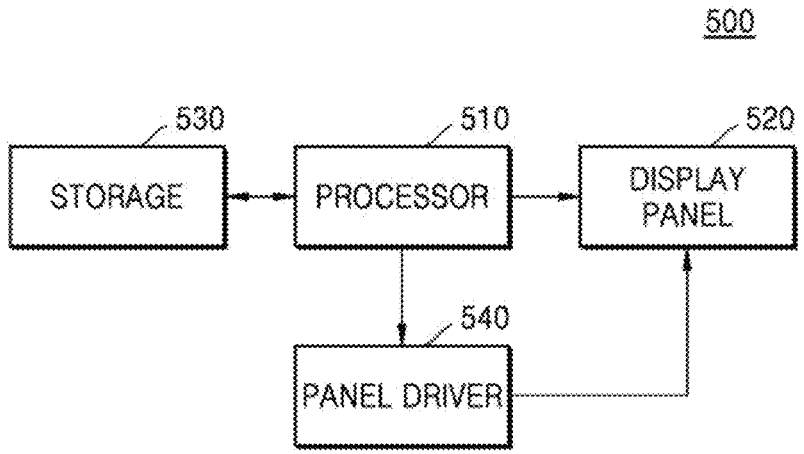
FIG. 5 is a block diagram of an internal structure of a display apparatus according to an embodiment.

FIG. 5 is a block diagram of an internal structure of a display apparatus 500 according to an embodiment. Referring to FIG. 5, the display apparatus 500 may include a processor 510, a display panel 520, a storage (memory) 530, and a panel driver 540.

The display apparatus 500 may be a digital television (TV), a three-dimensional (3D) TV, a smart TV, an LED TV, etc., and may include not only a flat display apparatus, but also a curved display apparatus with a screen having a curvature or a flexible display apparatus having an adjustable curvature. An output resolution of the display panel 520 may correspond to high definition (HD), full HD, ultra HD, 8K ultra HD, or a resolution for achieving a more vivid output image than 8K ultra HD.

The display panel 520 may include a panel including an LED. Also, the display panel 520 may include a micro LED.

A thin-film transistor (TFT) including a TFT layer (or a backplane) for driving a self-emission light source may not be limited to a particular structure or type. That is, according to an embodiment, the TFT may also be realized as an oxide TFT, a Si TFT (poly silicon, a-silicon), an organic TFT, a graphene TFT, or the like, in addition to an LTPS TFT. Also, only a p-type (or n-type) MOSFET may be manufactured in a Si safer CMOS process and applied as the TFT.

The display panel 520 may include a set of a plurality of cabinets. Each cabinet may include a set of a plurality of modules. Also, each module may include a plurality of devices arranged in the form of a matrix. When the display apparatus 500 corresponds to a micro LED TV, each module may include micro LEDs that have normally an array size of 480×270. One pixel may include three light-emitting devices, namely, a red LED, a green LED, and a blue LED. Thus, one module may include the total 388,800 light-emitting devices.

According to an embodiment, the display panel 520 may be implemented, as an individual device, in a wearable device, a portable device, a handheld device, and various other electronic products or devices, for which displays are required. Also, the display panel 520 may be applied to a display apparatus, such as a personal computer (PC) monitor, a high-resolution TV and signage, an electronic display, etc. in the form of a matrix through a plurality of assembled pieces.

The panel driver 540 may drive the display panel 520 under control of the processor 510. The panel driver 540 may drive the entire display panel 520 or drive the display panel 520 in the unit of a cabinet, which is included in the display panel, in the unit of a module, which is included in the cabinet, in the unit of a pixel, which is included in the module, or in the unit of a light-emitting device, which is included in the pixel. The panel driver 540 may supply a driving signal to the display panel 520 according to each driving unit. The driving signal may include a driving voltage or a driving current.

The storage 530 may store data required for an operation of the display apparatus 500 and programs for a processing and controlling operation of the processor 510.

According to an embodiment, the storage 530 may store a plurality of calibration matrices for each pixel. According to an embodiment, the plurality of calibration matrices may include a white calibration matrix used when an input image is a white image and a color calibration matrix used when an input image is a red, green, or blue image.

According to an embodiment, the plurality of calibration matrices may include an interpolation matrix generated by interpolating the white calibration matrix and the color calibration matrix, wherein the interpolation matrix is used when the input image is not the white, red, green, or blue image.

According to an embodiment, the plurality of calibration matrices may include a low gradation white calibration matrix and a low gradation color calibration matrix, and a high gradation white calibration matrix and a high gradation color calibration matrix, used when the input data is in a low gradation and a high gradation.

According to an embodiment, the plurality of calibration matrices may include an interpolation matrix generated by interpolating the low gradation calibration matrices and the high gradation calibration matrices, wherein the interpolation matrix is used when the input data is not in the low gradation or the high gradation.

The storage 530 may store at least one instruction executable by the processor 510. According to an embodiment, the at least one instruction stored in the storage 530 may include instructions for identifying one calibration matrix from among a plurality of calibration matrices stored for each pixel and generating an output signal with respect to light-emitting devices included in each pixel by using the identified calibration matrix. According to an embodiment, the at least one instruction stored in the storage 530 may include instructions for generating a new calibration matrix by using a plurality of calibration matrices and generating an output signal by using the generated calibration matrix.

A first gamma look-up table and a second gamma look-up table for digital modulation of input data may be stored in the storage 530.

The storage 530 may be provided as internal memories included in the processor 510, such as read-only memory (ROM), random-access memory (RAM), etc., or may be realized as a separate memory outside the processor 510. When the storage 530 is a separate memory outside the processor 510, the storage 530 may be a memory embedded in the display apparatus 500 or a memory detachable from the display apparatus 500.

The processor 510 may control general operations of the display apparatus 500. The processor 510 may execute functions of the display apparatus 500 by executing the one or more instructions stored in the storage 530. FIG. 5 shows one processor 510. However, the display apparatus 500 may further include a plurality of processors. In this case, according to an embodiment, each operation performed by the display apparatus 500 may be executed by at least one of the plurality of processors.

The processor 510 may obtain first modulation data from input data by using the first gamma look-up table. The first gamma look-up table may be used to modulate a data signal by using a virtual gamma value. The virtual gamma value may be 2.2, which is a standard gamma value.

According to an embodiment, the processor 510 may adaptively identify a calibration matrix based on input data and may calibrate the first modulation data by using the identified calibration matrix. Calibrating data using the calibration matrix may denote a process performed by the display apparatus 500 to minimize a difference of colors and/or brightnesses between pixels. Minimizing the difference of the colors and/or the brightnesses between the pixels may denote having the output colors of light-emitting devices included in each pixel being colors suitable for the standards of an RGB color space and having the brightness characteristics of the light-emitting devices included in each pixel be the same as the standard gamma value characteristics.

As described above, light-emitting devices included in the display panel 520 may have characteristics that are not the same as one another for various reasons. Thus, the processor 510 may calibrate input data or first modulation data obtained from the input data by using the calibration matrix, in order to reduce the difference of colors and/or brightnesses between the light-emitting devices included in respective pixels.

According to an embodiment, the processor 510 may select one of a plurality of calibration matrices stored for each pixel or generate a new calibration matrix by using the plurality of calibration matrices and may calibrate the first modulation data with respect to the light-emitting devices included in each pixel by using the selected or generated calibration matrix.

According to an embodiment, the processor 510 may identify a calibration matrix corresponding to an input image or input data. According to an embodiment, the processor 510 may select one of the plurality of calibration matrices stored in the storage 530, according to the input data. For example, when the input data of the input image corresponds to data indicating a white image, the processor 510 may select and use a white calibration matrix stored in the storage 530.

For example, when the input data corresponds to data indicating a red, green, or blue image, the processor 510 may select and use a color calibration matrix stored in the storage 530.

For example, when the input data corresponds to the data indicating the white image and corresponds to a low gradation, the processor 510 may select and use a low gradation white calibration matrix stored in the storage 530. Also, when the input data corresponds to the data indicating the white image and corresponds to a high gradation, the processor 510 may select and use a high gradation white calibration matrix stored in the storage 530.

When the input data corresponds to the data indicating the red, green, or blue image and corresponds to a low gradation, the processor 510 may select and use a low gradation color calibration matrix stored in the storage 530. Also, when the input data corresponds to the data indicating the red, green, or blue image and corresponds to a high gradation, the processor 510 may select and use a high gradation color calibration matrix stored in the storage 530.

According to another embodiment, the memory 530 may store only the white calibration matrix and the color calibration matrix for each pixel. When the input data of a pixel corresponds to data indicating an image which is not the white, red, green, or blue image, the processor 510 may use and generate an interpolation matrix by using the white calibration matrix and the color calibration matrix stored in the storage 530.

According to another embodiment, when the storage 530 stores only the high gradation calibration matrices and the low gradation calibration matrices, and when the input data does not correspond to the high gradation and the low gradation, the processor 510 may use and generate an interpolation matrix by using the high gradation calibration matrices and the low gradation calibration matrices stored in the storage 530.

The processor 510 may calibrate the first modulation data by using the calibration matrix and may modulate the calibrated value again according to the second gamma look-up table to obtain second modulation data. The second gamma look-up table may be used to modulate a data signal by using a virtual gamma value, as the first gamma look-up table. The virtual gamma value used in the second gamma look-up table may be 1/2.2 corresponding to a reciprocal value of a standard gamma value.

The processor 510 may apply an analog gamma value to the second modulation data obtained based on the second gamma look-up table. The analog gamma value may be a physical gamma value which may adjust a signal via a voltage, unlike the first gamma look-up table or the second gamma look-up table using the virtual gamma values. The processor 510 may change the second modulation data to a driving signal, such as a voltage or a current, which may be applied to a driving device, by applying the analog gamma value to the second modulation data.

The processor 510 may control the panel driver 540 such that the panel driver 540 applies a driving signal to a certain light-emitting device included in the display panel 520. The panel driver 540 may apply the driving signal to the certain light-emitting device so that the light-emitting device may emit light.

According to an embodiment, the display apparatus 500 may perform calibration by applying appropriate calibration matrices according to the characteristics of the input data. Therefore, colors, brightnesses, color temperatures, etc. of signals that are output from the light-emitting devices may become uniform, and consequently, colors and brightnesses that are output from the pixels may become uniform.

Figure 6:
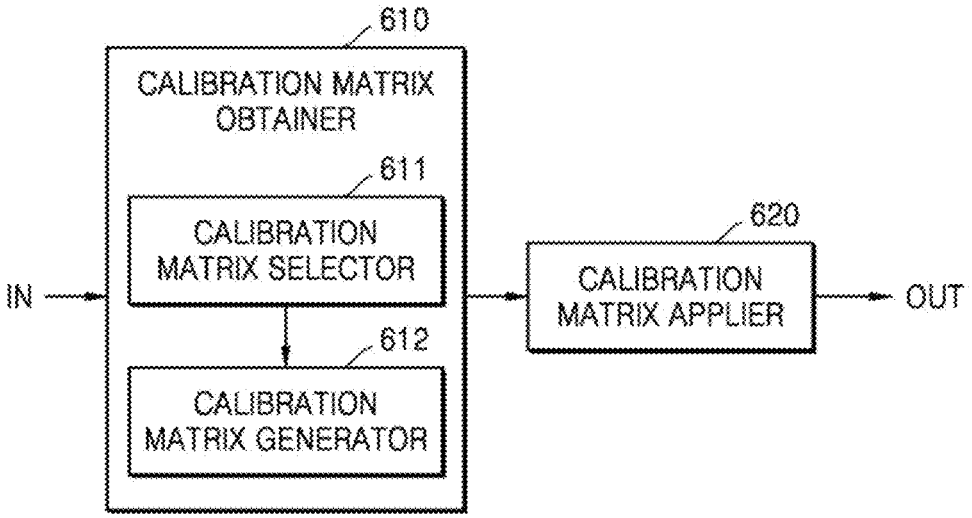
FIG. 6 is a block diagram of an internal structure of a processor of FIG. 5, according to an embodiment.

FIG. 6 is a block diagram of an internal structure of the processor 510 of FIG. 5, according to an embodiment. Referring to FIG. 6, the processor 510 may include a calibration matrix obtainer 610 and a calibration matrix applier 620.

The calibration matrix obtainer 610 may obtain a calibration matrix appropriate for input data IN, by using the input data IN. To this end, the calibration matrix obtainer 610 may include a calibration matrix selector 611 and a calibration matrix generator 612.

The calibration matrix selector 611 may select one of a plurality of calibration matrices stored in the storage 530. According to an embodiment, the storage 530 may store the plurality of calibration matrices for each pixel. The plurality of calibration matrices may include white calibration matrices used when the input data IN of a pixel is a white image and color calibration matrices used when the input data IN of a pixel corresponds to data indicating a red, green, or blue image. According to an embodiment, the plurality of calibration matrices may include an interpolation matrix generated by interpolating the white calibration matrices and the color calibration matrices, wherein the interpolation matrix is used when the input data does not correspond to data indicating a white, red, green, or blue image. According to an embodiment, the plurality of calibration matrices may include a low gradation white calibration matrix and a low gradation color calibration matrix, and a high gradation white calibration matrix and a high gradation color calibration matrix, used when the input data is in a low gradation and a high gradation. According to an embodiment, the plurality of calibration matrices may include an interpolation matrix generated by interpolating the low gradation calibration matrices and the high gradation calibration matrices, wherein the interpolation matrix is used when the input data is not in the low gradation or the high gradation.

The calibration matrix selector 611 may determine whether there is a calibration matrix, from among the plurality of calibration matrices stored for each pixel, is appropriate for the input data IN. When there is a calibration matrix to be applied to the input data IN, calibration matrix selector 611 may select the calibration matrix. The calibration matrix selector 611 may notify the calibration matrix applier 620 about the selected calibration matrix.

According to an embodiment, from among the plurality of calibration matrices stored in the storage 530, there may be no calibration matrix appropriate for the input data IN of a pixel. In this case, the calibration matrix selector 611 may notify the calibration matrix generator 612 about the information that there is no appropriate calibration matrix.

When the calibration matrix generator 612 receives the signal that there is no appropriate calibration matrix from the calibration matrix selector 611, the calibration matrix generator 612 may generate the calibration matrix to be applied to the input data IN.

For example, while the storage 530 may include only the white calibration matrix and the color calibration matrix, there may be a case in which the input data IN corresponds to data indicating an image other than the white, red, green, or blue image. In this case, the calibration matrix selector 611 may notify the calibration matrix generator 612 about the information that there is no appropriate calibration matrix. The calibration matrix generator 612 may generate an interpolation matrix by using the white calibration matrix and the color calibration matrix stored in the storage 530.

According to an embodiment, when the storage 530 stores only high gradation calibration matrices and low gradation calibration matrices, and when the input data IN does not correspond to a high gradation and a low gradation, the calibration matrix generator 612 may generate an interpolation matrix by using the high gradation calibration matrices and the low gradation calibration matrices stored in the storage 530.

The calibration matrix generator 612 may transmit the generated interpolation matrix to the calibration matrix applier 620.

When the calibration matrix selector 611 identifies and notifies the appropriate calibration matrix, the calibration matrix applier 620 may take the identified calibrated matrix from the storage 530 to calibrate modulation data with respect to the input data IN.

When the calibration matrix generator 612 generates a new interpolation matrix, the calibration matrix applier 620 may identify the generated interpolation matrix and use the identified interpolation matrix to calibrate the modulation data with respect to the input data IN.

The calibration matrix applier 620 may output the calibrated modulation data as an output signal OUT. The processor 510 may apply a second gamma look-up table to the calibrated modulation data which is output by the calibration matrix applier 620 and may apply an analog gamma value to a value resulting from the above operation to generate a driving signal for each of light-emitting devices included in pixels.

Figure 7:
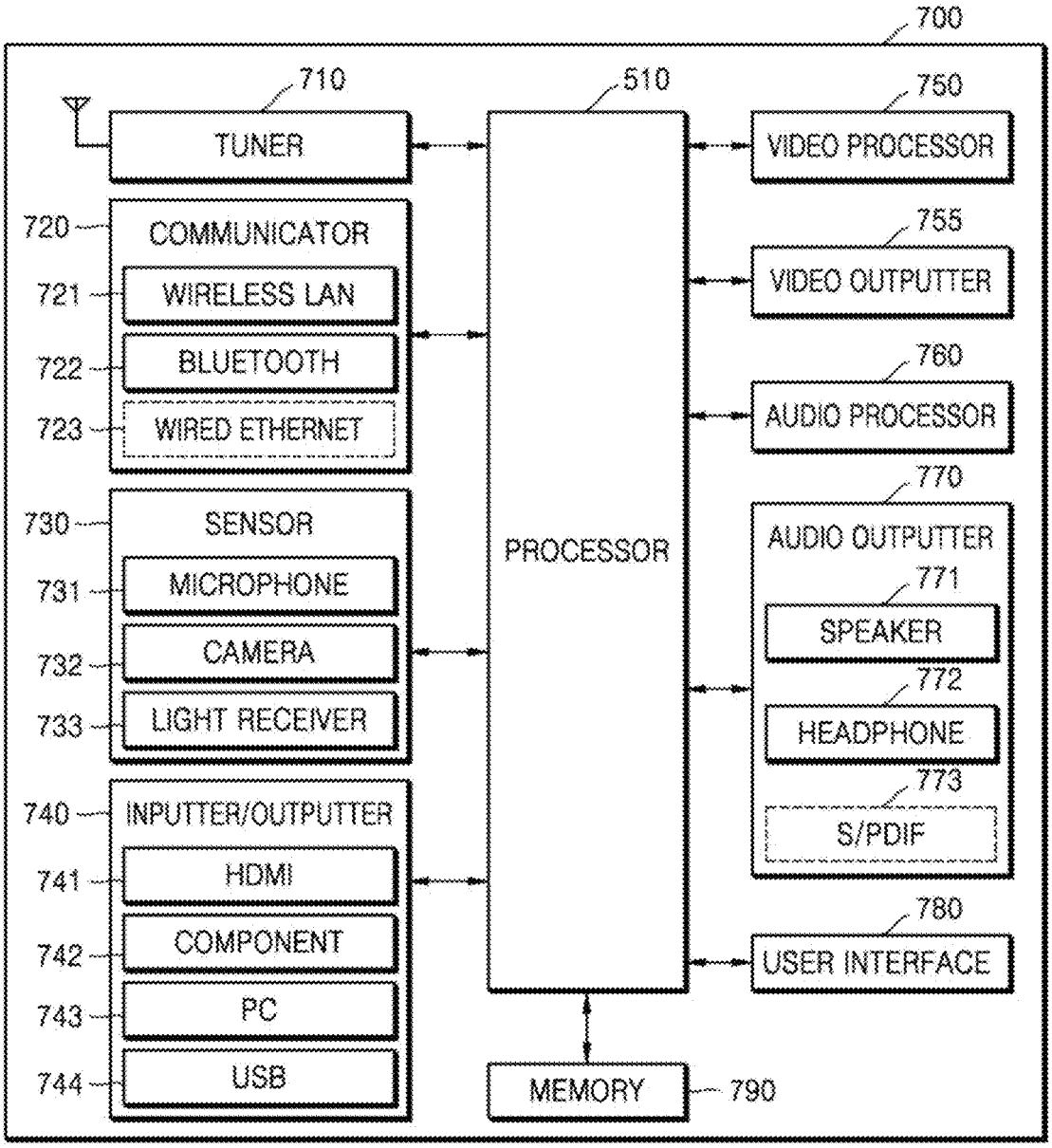
FIG. 7 is a block diagram of an internal structure of a display apparatus according to an embodiment.

FIG. 7 is a block diagram of an internal structure of a display apparatus 700 according to an embodiment.

Referring to FIG. 7, the display apparatus 700 may include the processor 510, the memory 790, a tuner 710, a communicator 720, a sensor 730, an inputter/outputter 740, a video processor 750, a video outputter 755, an audio processor 760, an audio outputter 570, and a user interface 780.

The processor 510 of FIG. 7 may perform the same functions as the processor 510 described with reference to FIGS. 5 and 6. Thus, the same functions will not be repeatedly described.

The tuner 710 may tune and select only frequencies of a channel to be received by the display apparatus 700, from many radio components, through amplification, mixing, resonance, etc. of broadcasting content received with or without wires. The content received by the tuner 710 may be decoded (for example, audio decoding, video decoding, or additional information decoding) and separated into audio data, video data, and/or additional information. The separated audio data, video data, and/or additional information may be stored in the memory 790 under control of the processor 510.

The communicator 720 may include one or more communication modules, such as a short-range wireless communication module, a wired communication module, a mobile communication module, a broadcasting reception module, etc. Here, the one or more communication modules refer to communication modules capable of performing data transmission and reception via networks in compliance with the communication standards, such as a tuner, Bluetooth, wireless LAN (WLAN) (Wi-Fi), wireless broadband (Wibro), world interoperability for microwave access (Wimax), CDMA, and WCDMA.

The communicator 270 may connect the display apparatus 700 to an external apparatus or server, or the apparatus 100 for generating the calibration matrix, under control of the processor 510. The display apparatus 700 may download, or receive, in real time, the plurality of calibration matrices according to an embodiment, from an external server or the apparatus 100 for generating the calibration matrix. The external server or the apparatus 100 for generating the calibration matrix being connected to the display apparatus 700 through the communicator 720.

Also, the display apparatus 700 may web-browse or download a program or an application required by the display apparatus 700 from an external apparatus, etc., via the communicator 720.

The communicator 720 may include one of wireless LAN 721, Bluetooth 722, and wired Ethernet 723, to correspond to the performance and the structure of the display apparatus 700. Also, the communicator 720 may include a combination of the wireless LAN 721, the Bluetooth 722, and the wired Ethernet 723. The communicator 720 may receive a control signal through a control device under control of the processor 510. The control signal may be a Bluetooth type, a radio frequency (RF) signal type, or a Wi-fi type. The communicator 720 may further include other short-range wireless communicators (for example, a near-field communicator (NFC), Bluetooth low energy (BLE)), in addition to the Bluetooth 722. According to an embodiment, the communicator 720 may transmit and receive connection signals to and from an external device, etc., by using short-range wireless communication methods, such as the Bluetooth 522 or the BLE.

The sensor 730 may sense a voice of a user, an image of the user, or an interaction of the user and may include a microphone 731, a camera 732, and a light receiver 733. The microphone 731 may receive an uttered voice of the user and may convert the received voice into an electrical signal and output the electrical signal through the processor 510.

The camera 732 may include a sensor and a lens and may capture an image formed on a screen.

The light receiver 733 may receive a light signal (including a control signal). The light receiver 733 may receive the light signal corresponding to a user input (for example, a touch operation, a press operation, a touch gesture, a voice, or a motion) from a control device, such as a remote controller or a cellular phone. The control signal may be extracted from the received light signal under control of the processor 510.

The inputter/outputter 740 may receive video data (for example, a video signal or a still image signal), audio data (for example, a voice signal or a sound signal), and additional information (for example, content description, a content title, a content storage location) from a server, etc. located outside the display apparatus 700 under control of the processor 510. The inputter/outputter 740 may include one of a high-definition multimedia interface (HDMI) port 741, a component jack 742, a PC port 743, and a universal serial bus (USB) port 744. The inputter/outputter 740 may include a combination of the HDMI port 741, the component jack 742, the PC port 743, and the USB port 744.

The memory 790 according to an embodiment may store instructions and programs for processing and controlling operations of the processor 510. The memory 790 of FIG. 7 may perform functions corresponding to the functions of the storage 530 of FIG. 5. Thus, aspects about the memory 790 that are the same as the aspects of the storage 530 of FIG. 5 will not be described. The memory 790 may store data that is input to the display apparatus 700 or output from the display apparatus 700. Also, the memory 790 may store information or data required for an operation of the display apparatus 700.

According to an embodiment, the programs stored in the memory 790 may be classified into a plurality of modules according to functions of the programs. The memory 790 may store a plurality of calibration matrices for each pixel. When the processor 510 generates a new interpolation matrix, the memory 790 may store the generated interpolation matrix to correspond to a corresponding pixel. The memory 790 may store programs, etc. used for applying the plurality of calibration matrices, generating the new interpolation matrix from the plurality of calibration matrices, or applying the generated interpolation matrix.

The processor 510 may control general operations of the display apparatus 700 and signal flows between internal components of the display apparatus 700 and may process data. When there is a user input or when a pre-determined condition that is stored is satisfied, the processor 510 may execute an operation system (OS) and various applications stored in the memory 790.

According to an embodiment, the processor 510 may execute one or more instructions stored in the memory 790 to identify a calibration matrix according to input data and calibrate first modulation data corresponding to the input data by using the identified calibration matrix.

According to an embodiment, the processor 510 may include a plurality of processors. In this case, the operation of selecting one of the plurality of calibration matrices or generating the new interpolation matrix from the stored calibration matrices to calibrate the modulation data with respect to the input data may be performed by a different processor.

Also, the processor 510 may include an internal memory. In this case, at least one of the data, the programs, or the instructions stored in the memory 790 may be stored in the internal memory of the processor 510.

The video processor 750 may process image data to be displayed by the video outputter 755 and may perform various image processing operations on image data, such as decoding, rendering, scaling, noise filtering, frame rate conversion, and resolution conversion.

The video outputter 755 may display an image signal included in content received by the tuner 710 on a screen under control of the processor 510. Also, the video outputter 755 may display content (for example, video data) that is input through the communicator 720 or the inputter/outputter 740. According to an embodiment of the disclosure, the video outputter 755 may adaptively select one of the plurality of calibration matrices or generate a new interpolation matrix under control of the processor 510, and may use the selected or generated calibration matrix to calibrate and output data, so that an image having a uniform brightness and a uniform color, in which different characteristics between the light-emitting devices are adaptively calibrated, may be output. The video outputter 755 of FIG. 7 may perform the same functions as the display panel 520 described with reference to FIG. 5.

When the video outputter 755 is a touch screen, the video outputter 755 may be used as an input device, in addition to an output device. The video outputter 755 may be a panel including an LED.

The audio processor 760 may process audio data. The audio processor 760 may perform various processing operations on the audio data, such as decoding, amplification, noise filtering, etc.

The audio outputter 770 may output audio data included in content received by the tuner 710, audio data that is input through the communicator 720 or the inputter/outputter 740, or audio data stored in the memory 790, under control of the processor 510. The audio outputter 770 may include at least one of a speaker 771, a headphone output terminal 722, or a Sony/Philips digital interface (S/PDIF) output terminal 773.

The user interface 780 may denote a device used by a user to input data to control the display apparatus 700. The user interface 780 may be a device for controlling the display apparatus 700, such as a key pad. When the video outputter 755 is a touch screen, the user interface 780 may be replaced by a user finger or an input pen. The user interface 780 may control functions of the display apparatus 700 by using a sensor capable of recognizing motions, as well as by using a key pad, a dome switch, a jog wheel, a jog switch, a button, and a touch pad. Also, the user interface 780 may include a pointing device. For example, the user interface 780 may operate as the pointing device when a certain key input is received. According to an embodiment, the sensor 730 may perform functions of the user interface 780. For example, the microphone 731 capable of receiving a voice of a user may recognize a voice command of a user as a control signal.

The user may perform environment setting of the display apparatus 700 via the user interface 780. The user may input user input information via the user interface 350. According to an embodiment, a user may use the user interface 780 to instruct the display apparatus 500 to calibrate the input data by using a calibration matrix or to use a specific calibration matrix from among a plurality of calibration matrices.

The block diagrams of the display apparatuses 500 and 700 illustrated in FIGS. 5, 6, and 7 are block diagrams according to an embodiment. The components of the block diagrams may be integrated, added, or omitted according to the specification of a display apparatus actually realized. For example, two or more components may be combined into one component or one component may be divided into two or more components, according to necessity. Also, functions performed by each block are described to describe embodiments, and their detailed operations or devices do not limit the scope of the claims.

Figure 8:
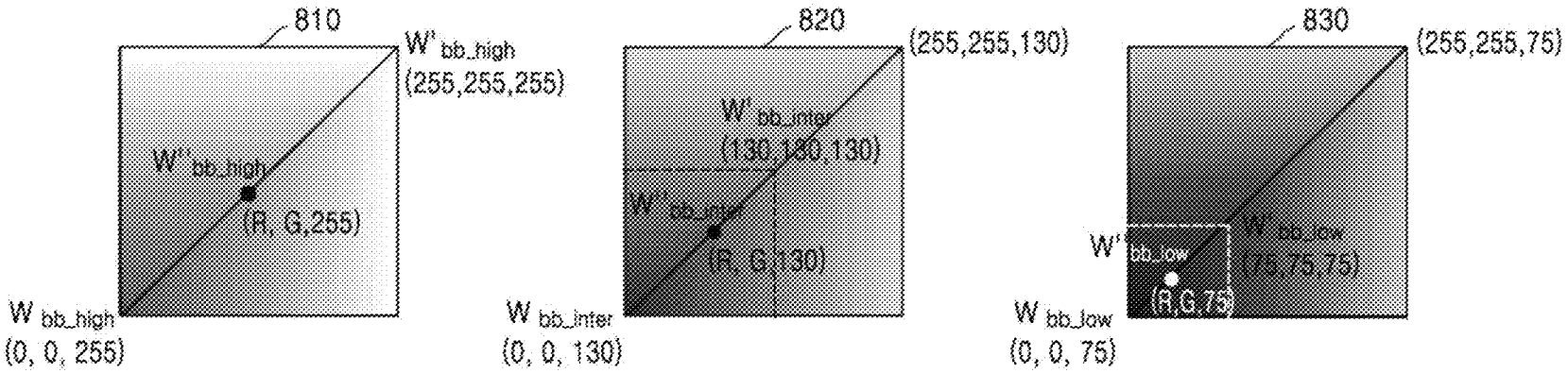
FIG. 8 is a diagram showing an operation of obtaining a coefficient of an interpolation matrix, according to an embodiment.

FIG. 8 is a diagram showing an operation of obtaining a coefficient of an interpolation matrix, according to an embodiment. According to an embodiment, the apparatus 100 for generating the calibration matrix may generate the white calibration matrix and the color calibration matrix, and then, may generate the interpolation matrix by interpolating the white calibration matrix and the color calibration matrix.

As described above, the light-emitting devices may have different brightness characteristics between a low gradation and a high gradation. Thus, the measured brightnesses may be different between the low gradation and the high gradation, and thus, coefficients included in calibration matrices may be different between the low gradation and the high gradation. According to an embodiment, the apparatus 100 for generating the calibration matrix may generate a high gradation calibration matrix and a low gradation calibration matrix for each pixel.

The apparatus 100 for generating the calibration matrix may generate a high gradation white calibration matrix and a high gradation color calibration matrix and a low gradation white calibration matrix and a low gradation color calibration matrix. According to an embodiment, the apparatus 100 for generating the calibration matrix may generate the interpolation matrix by interpolating the high gradation white calibration matrix and the high gradation color calibration matrix, for a case in which the input image is in the high gradation and does not correspond to a white, red, green, or blue image. Also, the apparatus 100 for generating the calibration matrix may generate the interpolation matrix by interpolating the low gradation white calibration matrix and the low gradation color calibration matrix, for a case in which the input image is in the low gradation and does not correspond to the white, red, green, or blue image.

Alternatively, according to an embodiment, the display apparatus 500, rather than the apparatus 100 for generating the calibration matrix, may generate and use the interpolation matrices. The display apparatus 500 may generate the interpolation matrix which is appropriate for an input image, for each pixel, by using the plurality of calibration matrices generated by the apparatus 100 for generating the calibration matrix and stored in the storage 530. For example, the display apparatus 500 may generate the interpolation matrix which is appropriate for an input image by using the white calibration matrix and the color calibration matrix, when the input image does not correspond to the white, red, green, or blue image.

Also, the display apparatus 500 may generate the interpolation matrix by interpolating the high gradation white calibration matrix and the high gradation color calibration matrix stored in the storage 530 or may generate the interpolation matrix by interpolating the low gradation white calibration matrix and the low gradation color calibration matrix, according to a gradation of the input image.

FIG. 8 includes a left FIG. 810, an intermediate FIG. 820, and a right FIG. 830 for describing methods of obtaining coefficients of interpolation matrices which are appropriate for input images by using coefficients of a white calibration matrix and a color calibration matrix, when the input images correspond to a high gradation image, an intermediate gradation image, and a low gradation image, respectively.

In FIG. 8, the left FIG. 810 shows the method of obtaining a coefficient value, $w''_{bb_high}$, which is appropriate for the input image, by using a coefficient value, $w'_{bb_high}$, included in the high gradation white calibration matrix, and a coefficient value, $w_{bb_high}$, included in the high gradation color calibration matrix. $w_{bb}$ is a blue-color-related coefficient which is included in the calibration matrix, as described with reference to Equation 2. Also, $w_{bb}$ may be a coefficient used to change a measured brightness of the blue color to a target brightness.

When gradation values of the input image in the left FIG. 810 are R, G, 255, that is, when the blue color has a value of 255, and the red and green colors have a certain value, the apparatus 100 for generating the calibration matrix or the display apparatus 500 may interpolate the coefficients values $w'_{bb_high}$ and $w_{bb_high}$ to obtain the new coefficient value $w''_{bb_high}$.

Methods of interpolating two points may include polynomial interpolation, spline interpolation, linear interpolation, etc. A method performing the apparatus 100 for generating the calibration matrix or the display apparatus 500 to use the linear interpolation will be described with reference to FIG. 8. However, the method is only an example, and the apparatus 100 for generating the calibration matrix or the display apparatus 500 may use various other methods than the linear interpolation to obtain the interpolation coefficient to generate the calibration matrix.

Linear interpolation refers to a method of estimating a value between two points by linearly determining the value according to a straight distance between the two points. For example, when data values at two points x1 and x2 are respectively f(x1) and f(x2), a data value f(x) at a certain point x (x1ÂxÂx2) between the two points x1 and x2 may be calculated based on Equation 4 below by using the linear interpolation.

$$f(x) = \frac{d2}{d1+d2} f(x1) + \frac{d1}{d1+d2} f(x2) \tag{4}$$

According to an embodiment, the apparatus 100 for generating the calibration matrix or the display apparatus 500 may identify a greater value of R and G, the gradations of the input image, and may obtain the new coefficient value by using the linear interpolation of Equation 4 above. For example, when a pixel value of the input image is 50, 25, 255, the apparatus 100 for generating the calibration matrix or the display apparatus 500 may use 50, which is the greater value between R and G, and obtain the interpolation coefficient value $w''_{bb_high}$, which is appropriate for input data, based on a value between 0 and 255, as shown in Equation 5 below.

$$w''_{bb_{high}} = \frac{255-50}{255} w_{bb_{high}} + \frac{50-0}{255} w'_{bb_{high}} \tag{5}$$

In FIG. 8, the right FIG. 830 shows the method of obtaining a coefficient value, $w''_{bb_low}$, which is appropriate for the input image, by using a coefficient value, $w'_{bb_low}$, included in the low gradation white calibration matrix, and a coefficient value, $w_{bb_low}$, included in the low gradation color calibration matrix.

When the gradation values of the input image in the right FIG. 830 are R, G, 75, the apparatus 100 for generating the calibration matrix or the display apparatus 500 may obtain the new coefficient value $w''_{bb_low}$, by interpolating the coefficient values $w''_{bb_low}$ and $w'_{bb_low}$. The apparatus 100 for generating the calibration matrix or the display apparatus 500 may identify a greater value of R and G, the gradation values of the input image, and the identified value may be between 0 and 75. Thus, the apparatus 100 for generating the calibration matrix or the display apparatus 500 may obtain the coefficient value $w''_{bb_high}$ by using Equation 4 above based on substantially the same method as Equation 5.

In FIG. 8, the intermediate FIG. 820 shows the method of obtaining a coefficient value, $w''_{bb_inter}$, which is appropriate for the input image, by using a coefficient value, $w'_{bb_inter}$, included in the intermediate gradation white calibration matrix, and a coefficient value, $w_{bb_inter}$, included in the intermediate gradation color calibration matrix.

According to an embodiment, the apparatus 100 for generating the calibration matrix or the display apparatus 500 may obtain the intermediate gradation coefficient value by using the high gradation and low gradation coefficient values. That is, the apparatus 100 for generating the calibration matrix or the display apparatus 500 may obtain the coefficient value $w_{bb_inter}$, included the intermediate gradation color calibration matrix, as below, based on Equation 4 above, by using the coefficient value $w_{bb_low}$, included in the low gradation color calibration matrix, and the coefficient value $w_{bb_high}$, included in the high gradation color calibration matrix.

Similarly, the apparatus 100 for generating the calibration matrix or the display apparatus 500 may obtain the coefficient value $w'_{bb_inter}$, included the intermediate gradation white calibration matrix, based on Equation 6 below, by using the coefficient value $w'_{bb_low}$, included in the low gradation white calibration matrix, and the coefficient value $w'_{bb_high}$, included in the high gradation white calibration matrix.

$$w_{bb_{inter}} = \frac{255-130}{255-75} w_{bb_{low}} + \frac{130-75}{255-75} w_{bb_{high}} \tag{6}$$

The apparatus 100 for generating the calibration matrix or the display apparatus 500 may obtain the coefficient value $w''_{bb_inter}$, which is appropriate for the input image, similarly as Equation 7 below, by interpolating the coefficient value $w'_{bb_inter}$, included in the intermediate gradation white calibration matrix, and the coefficient value $w_{bb_inter}$, included in the intermediate gradation color calibration matrix.

$$w'_{bb_{inter}} = \frac{255-130}{255-75} w'_{bb_{low}} + \frac{130-75}{255-75} w'_{bb_{high}} \tag{7}$$

Figure 9:
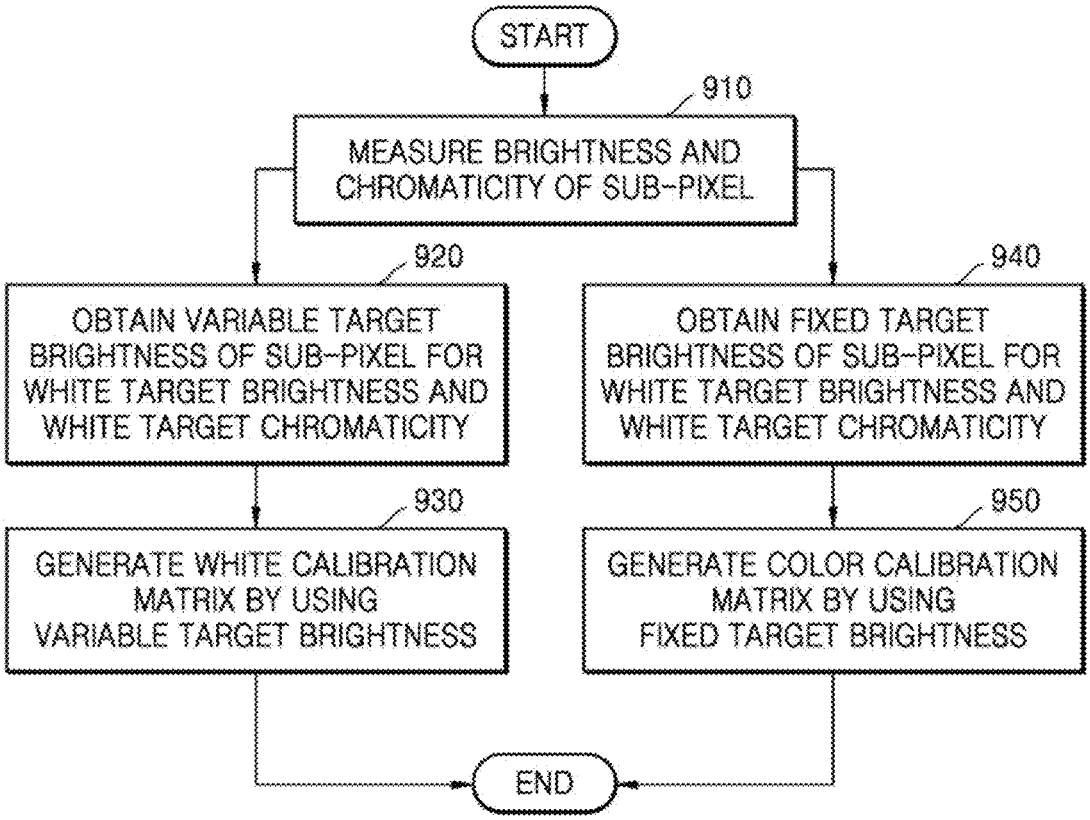
FIG. 9 is a flowchart of a method of generating a calibration matrix, according to an embodiment.

FIG. 9 is a flowchart of a method of generating a calibration matrix, according to an embodiment. Referring to FIG. 9, the apparatus 100 for generating the calibration matrix may measure a brightness and a chromaticity of a light-emitting device (operation 910). The apparatus 100 for generating the calibration matrix may capture a plurality of light-emitting devices of the display apparatus 500 by using a specific camera, etc. The apparatus 100 for generating the calibration matrix may measure the brightness and the chromaticity from each of the plurality of light-emitting devices included in pixels.

The apparatus 100 for generating the calibration matrix may measure the brightness and the chromaticity multiple times. The apparatus 100 for generating the calibration matrix may measure the brightness of each light-emitting device in different gradations, for example, a low gradation and a high gradation.

The apparatus 100 for generating the calibration matrix may obtain a variable target brightness of the light-emitting device for a white target brightness and a white target chromaticity (operation 920). The apparatus 100 for generating the calibration matrix may use the measured chromaticity with respect to a light-emitting device on which brightness calibration is to be performed and may use the target chromaticity with respect to a light-emitting device on which chromaticity calibration is to be performed, from among the light-emitting devices, in order to calculate whichever brightness has to be provided by each of the red LED, the green LED, and the blue LED for achieving the white target brightness and the white target chromaticity.

According to an embodiment, the apparatus 100 for generating the calibration matrix may generate, with respect to the blue LED, the variable target brightness by using the measured chromaticity, in order to perform only brightness calibration.

The apparatus 100 for generating the calibration matrix may generate the calibration matrix having values to calibrate the chromaticity and/or the brightness of each light-emitting device, for each pixel.

The apparatus 100 for generating the calibration matrix may generate a white calibration matrix by using the variable target brightness (operation 930).

For example, the apparatus 100 for generating the calibration matrix may generate a calibration matrix for performing the chromaticity calibration on the red LED and the green LED and performing the brightness calibration on the blue LED. To this end, the apparatus 100 for generating the calibration matrix may obtain red coefficient values and green coefficient value by using the target brightnesses of the red LED and the green LED and the target chromaticities of the red LED and the green LED, for generating the white target brightness and the white target chromaticity, and the measured chromaticities and the measured brightnesses of the red, green, and blue LEDs. With respect to the blue coefficient values, the apparatus 100 for generating the calibration matrix may set a coefficient value for chromaticity calibration of the blue LED as 0 and may obtain a coefficient value for only brightness calibration of the blue LED. The coefficient value for the brightness calibration of the blue LED may be obtained by using the target brightness and the measured brightness of the blue LED.

In an embodiment, the apparatus 100 for generating the calibration matrix may generate the coefficient value for only brightness calibration, also with respect to the red LED or the green LED, when a chromaticity deviation in the measured chromaticity of the red LED or the green LED is not greater than an average value or a certain reference value. The apparatus 100 for generating the calibration matrix may generate the calibration matrix having the generated coefficient values, for each pixel.

The apparatus 100 for generating the calibration matrix may obtain a fixed target brightness of the light-emitting device for the white target brightness and the white target chromaticity (operation 940).

The apparatus 100 for generating the calibration matrix may generate a fixed target brightness by using the target chromaticities of all of the light-emitting devices, in order to obtain whichever brightness is to be obtained by each of the red LED, the green LED, and the blue LED for achieving the white target brightness and the white target chromaticity. Here, an average value of measured chromaticities of all of the blue LEDs included in the plurality of pixels, or a fixed value, may be used as the target chromaticity of the blue LED. The fixed target brightness may have a fixed value, because the fixed target brightness is obtained by using the same fixed target chromaticity, rather than the target chromaticity having a different value for each light-emitting device.

The apparatus 100 for generating the calibration matrix may generate the color calibration matrix having the values for calibrating the chromaticity and/or brightness of each light-emitting device by using the fixed target brightness (operation 950).

The apparatus 100 for generating the calibration matrix may obtain the coefficient values with respect to the red LED or the green LED by using the fixed target brightness and the fixed target chromaticity with respect to the red LED or the green LED, and the measured brightness and the measured chromaticity of each of the red, green, and blue LEDs. Also, with respect to the blue LED, the apparatus 100 for generating the calibration matrix may set the coefficient value for chromaticity calibration of the blue LED as 0 and may obtain the coefficient value for only brightness calibration of the blue LED. The coefficient value for the brightness calibration of the blue LED may be obtained by using the target brightness and the measured brightness of the blue LED. Alternatively, the apparatus 100 for generating the calibration matrix may generate the coefficient value for performing only the brightness calibration, also with respect to the red LED or the green LED, in addition to the blue LED.

The apparatus 100 for generating the calibration matrix may generate the calibration matrix having the generated coefficient values, for each pixel.

Figure 10:
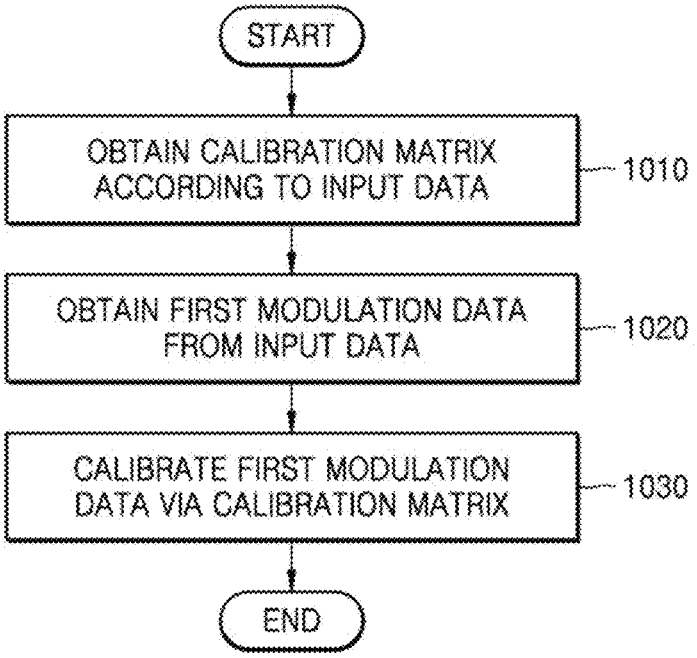
FIG. 10 is a flowchart of a method of calibration, according to an embodiment.

FIG. 10 is a flowchart of a method of calibration, according to an embodiment.

Referring to FIG. 10, the display apparatus 500 may adaptively identify and obtain a calibration matrix according to input data (operation 1010). The display apparatus 500 may obtain a white calibration matrix or a color calibration matrix, according to whether the input image is a white image or a red, green, or blue image. The display apparatus 500 may obtain the calibration matrix which is appropriate for each gradation, according to whether input data of the input image corresponds to a high gradation, an intermediate gradation, or a low gradation.

When the storage 530 does not store a calibration matrix which is appropriate for an input image, the display apparatus 500 may generate the calibration matrix which is appropriate for the input image for each pixel, by interpolating calibration matrices pre-stored in the storage 530.

The display apparatus 500 may obtain first modulation data from input data (operation 1020). The display apparatus 500 may obtain the first modulation data from the input data by using a first gamma look-up table. The first gamma look-up table may function as a virtual gamma module for performing digital modulation of a data signal. Values stored in the first gamma look-up table may have values resulting from calculations performed by applying the standard gamma value 2.2 to the input data.

The display apparatus 500 may calibrate the chromaticity and/or brightness by calibrating the first modulation data by applying the calibration matrix to the first modulation data (operation 1030). The display apparatus 500 may reduce differences of brightnesses and colors between pixels by performing calibration, thereby making the characteristics of the plurality of light-emitting devices, such as colors and brightnesses, uniform.

The display apparatus 500 may minimize the differences of brightnesses and colors between the light-emitting devices and the pixels by calibrating the first modulation data obtained from the input data by using the calibration matrix adaptively obtained according to the input data.

Figure 11:
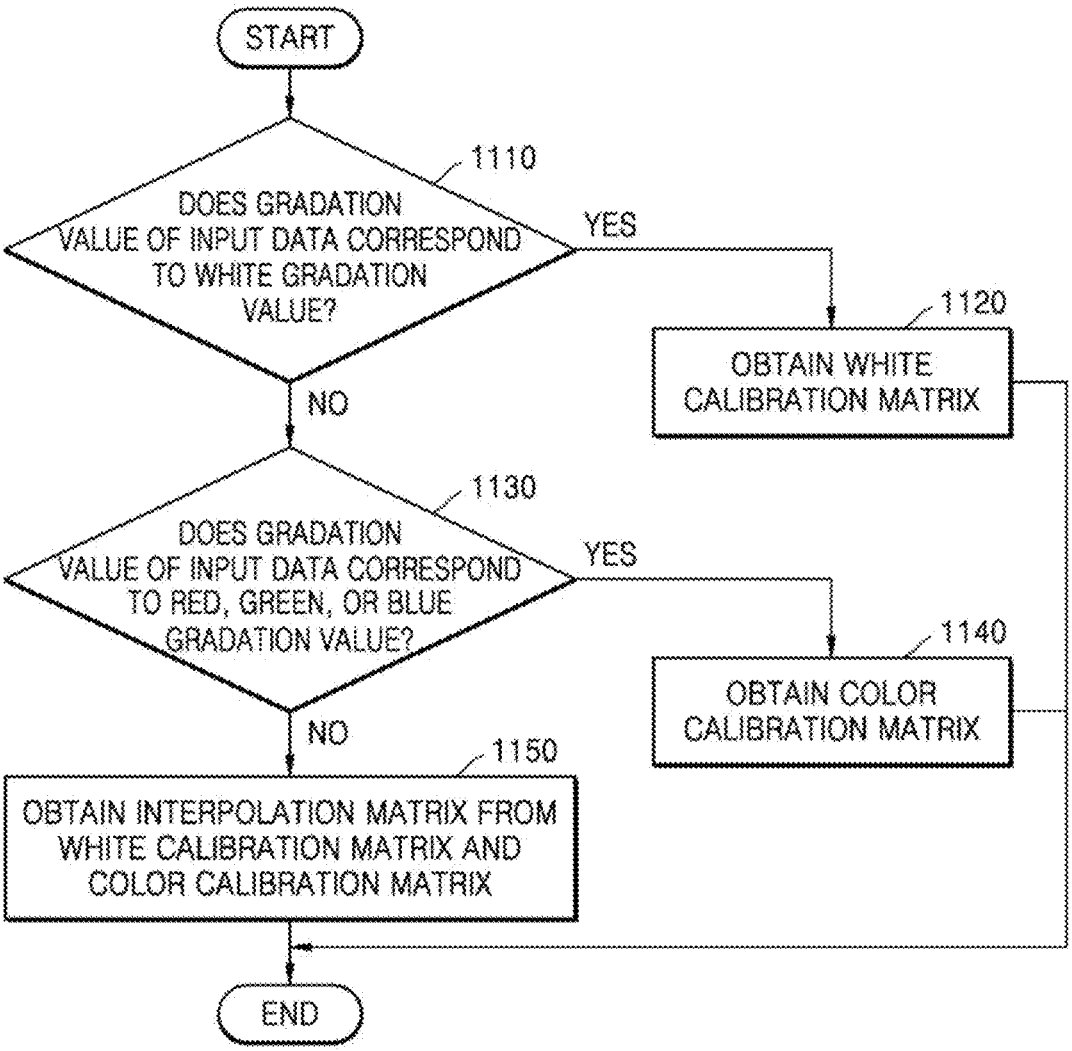
FIG. 11 is a flowchart of a method of obtaining a calibration matrix according to input data, according to an embodiment.

FIG. 11 is a flowchart of a method of obtaining a calibration matrix according to input data, according to an embodiment.

Referring to FIG. 11, the display apparatus 500 may determine a gradation value of the input data. The display apparatus 500 may determine whether the gradation value of the input data corresponds to 255, 255, 255, which is a gradation value of a white image (operation 1110). When the gradation value of the input data corresponds to the white gradation value, the display apparatus 500 may obtain the white calibration matrix (operation 1020). The display apparatus 500 may obtain the white calibration matrix pre-stored in the storage 530, or stream or download in real time the white calibration matrix from the apparatus 100 for generating the calibration matrix.

When the gradation value of the input data does not correspond to the white gradation value, the display apparatus 500 may determine whether the gradation value of the input data corresponds to a red, green, or blue gradation value (operation 1130). When the gradation value of the input data corresponds to a red, green, or blue gradation value, the display apparatus 500 may obtain the color calibration matrix (operation 1040).

When the gradation value of the input data does not correspond to the red, green, or blue gradation value, the display apparatus 500 may obtain the interpolation matrix from the white calibration matrix and the color calibration matrix (operation 1150). According to an embodiment of the disclosure, the display apparatus 500 may obtain the interpolation matrix obtained by using the white calibration matrix and the color calibration matrix, from the storage 530, or may receive the interpolation matrix from the apparatus 100 for generating the calibration matrix and use the interpolation matrix.

According to an embodiment of the disclosure, the display apparatus 500 may directly generate the interpolation matrix by using the white calibration matrix and the color calibration matrix pre-stored in the storage 530. The display apparatus 500 may perform the calibration by applying the obtained calibration matrix to the first modulation data of the input data.

The display apparatus, calibration apparatus, and the operating method thereof according to the one or more embodiments of the disclosure may also be implemented with a recording medium having recorded thereon instructions executable by computers, such as a program module to be executed in computers. Computer-readable media may be arbitrary media which may be accessed by computers and may include volatile and non-volatile media, and detachable and non-detachable media. Also, the computer-readable media may include computer storage media and communication media. The computer storage media include all of volatile and non-volatile media, and detachable and non-detachable media which are designed as methods or techniques to store information including computer-readable instructions, data structures, program modules, or other data. The communication media include transmission mechanisms or other data of modulated data signals, such as computer-readable instructions, data structures, and program modules. Also, the communication media include other information transmission media.

Also, in this specification, a "unit" may refer to a hardware component, such as a processor or a circuit, and/or a software component executed by a hardware component such as a processor.

Also, the display apparatus and the operating method thereof according to the one or more embodiments may be implemented as a computer program product including a recording medium having stored thereon a program for executing operations including: identifying one calibration matrix from among a plurality of calibration matrices according to input data of pixels; calibrating first modulation data corresponding to the input data via the identified calibration matrix; and driving a display panel by applying a driving signal with respect to the input data to a light-emitting device included in the pixels, the driving signal being generated from the calibrated first modulation data.

The method and the apparatus for generating the calibration matrix according to the one or more embodiments of the disclosure may generate a plurality of calibration matrices for each pixel.

The display apparatus and the operating method thereof according to the one or more embodiments of the disclosure may calibrate input data by adaptively selecting one of a plurality of calibration matrices according to an input image.

The display apparatus, calibration apparatus, and the operating method thereof according to the one or more embodiments of the disclosure may generate an interpolation matrix which is appropriate for an input image by interpolating a plurality of calibration matrices and may calibrate input data by using the generated interpolation matrix.

While the disclosure has been particularly shown and described with reference to example embodiments of the disclosure, it will be understood by one of ordinary skill in the art that various changes in form and details may be made therein without departing from the spirit and scope of the disclosure as defined by the following claims. Hence, it will be understood that the embodiments of the disclosure described above are examples in all aspects and are not limiting of the scope of the disclosure. For example, each of components described as a single unit may be executed in a distributed fashion, and likewise, components described as being distributed may be executed in a combined fashion.

What is claimed is:

1. An apparatus for generating a calibration matrix, the apparatus comprising:

a measurer configured to, for each pixel among a plurality of pixels, measure a brightness and a chromaticity for each light-emitting device of a plurality of light-emitting devices within the pixel; and a calibration matrix generator configured to, for each pixel among the plurality of pixels:

obtain a target brightness for each light-emitting device of the plurality of light-emitting devices corresponding to a white target brightness and a white target chromaticity, and generate a plurality of pixel specific calibration matrices for the pixel based on the target brightness for each light-emitting device of the plurality of light-emitting devices, a target chromaticity of a light-emitting device on which a chromaticity calibration is to be performed, and the measured brightness and the measured chromaticity for each light-emitting device of the plurality of light-emitting devices, wherein the calibration matrix is used to correct at least one of a brightness and a chromaticity of at least one light-emitting device included in the pixel so that the light-emitting device included in the pixel has a same color and brightness as a light-emitting device included in other pixels, wherein the calibration matrix generator is further configured to, for each pixel among the plurality of pixels:

obtain a variable target brightness for each light-emitting device of the plurality of light-emitting devices based on a measured chromaticity of a light-emitting device on which a brightness calibration is to be performed and the target chromaticity of the light-emitting device on which the chromaticity calibration is to be performed, obtain a fixed target brightness for each light-emitting device of the plurality of light-emitting devices based on a target chromaticity for each light-emitting device of the plurality of light-emitting devices, generate a pixel specific white calibration matrix from the variable target brightness, and generate a pixel specific color calibration matrix from the fixed target brightness.

2. The apparatus of claim 1, wherein the light-emitting device on which the brightness calibration is to be performed corresponds to a blue light-emitting diode (LED).

3. The apparatus of claim 1, wherein a target chromaticity of a blue light emitting diode (LED) is obtained from measured chromaticities of a plurality of blue LEDs.

4. The apparatus of claim 1, wherein the measurer is further configured to, for each pixel among the plurality of pixels, measure a plurality of brightnesses in a plurality of gradations including a low gradation and a high gradation, and wherein the calibration matrix generator is further configured to, for each pixel among the plurality of pixels, generate a pixel specific white calibration matrix and a pixel specific color calibration matrix for each gradation of the plurality of gradations based on the plurality of measured brightnesses in the plurality of gradations.

5. The apparatus of claim 4, wherein the calibration matrix generator is further configured to, for each pixel among the plurality of pixels:

generate a pixel specific interpolation white calibration matrix by interpolating the pixel specific white calibration matrix generated for each gradation of the plurality of gradations, and generate a pixel specific interpolation color calibration matrix by interpolating the pixel specific color calibration matrix generated for each of the plurality of gradations.

6. A method of generating a calibration matrix, the method comprising:

measuring, for each pixel among a plurality of pixels, a brightness and a chromaticity for each light-emitting device of a plurality of light-emitting devices within the pixel;

obtaining, for each pixel among the plurality of pixels, a target brightness for each light-emitting device of the plurality of light-emitting devices based on a white target brightness and a white target chromaticity; and generating, for each pixel among the plurality of pixels, a plurality of pixel specific calibration matrices for the pixel based on the target brightness for each light-emitting device of the plurality of light-emitting devices, a target chromaticity of a light-emitting device on which a chromaticity calibration is to be performed, and the measured brightness and the measured chromaticity for each light-emitting device of the plurality of light-emitting devices, wherein the calibration matrix is used to correct at least one of a brightness and a chromaticity of at least one light-emitting device included in the pixel so that the light-emitting device included in the pixel has a same color and brightness as a light-emitting device included in other pixels, wherein the obtaining of the target brightness for each of the plurality of light-emitting devices comprises:

obtaining a variable target brightness for each light-emitting device of the plurality of light-emitting devices based on a measured chromaticity of a light-emitting device on which a brightness calibration is to be performed and the target chromaticity of the light-emitting device on which the chromaticity calibration is to be performed; and obtaining a fixed target brightness for each of the plurality of light-emitting devices based on a target chromaticity for each of the plurality of light-emitting devices, and wherein the generating of the plurality of pixel specific calibration matrices comprises:

generating a white calibration matrix from the variable target brightness; and generating a color calibration matrix from the fixed target brightness.

7. The method of claim 6, wherein the light-emitting device on which the brightness calibration is to be performed corresponds to a blue light-emitting diode (LED) device.

8. The method of claim 7, wherein a target chromaticity of the blue LED is obtained from measured chromaticities of a plurality of blue LEDs.

9. The method of claim 6, wherein the measuring, for each pixel among the plurality of pixels, the brightness for each of the plurality of light-emitting devices comprises measuring a plurality of brightnesses in a plurality of gradations including a low gradation and a high gradation, and wherein the generating of the plurality of pixel specific calibration matrices, for each pixel among the plurality of pixels, comprises generating a white calibration matrix and a color calibration matrix for each of the plurality of gradations, based on the plurality of measured brightnesses in the plurality of gradations.

* * * * *